US005477843A

United States Patent [19]

Kunimoto

[11] Patent Number: 5,477,843

[45] **Date of Patent: * Dec. 26, 1995**

[54] MODEL GUN WITH AUTOMATIC BULLET SUPPLYING MECHANISM

[75] Inventor: Keiichi Kunimoto, Tokyo, Japan

[73] Assignee: Western Arms, Tokyo, Japan

[ * ] Notice: The portion of the term of this patent subsequent to Dec. 19, 2012, has been disclaimed.

[21] Appl. No.: 241,467

[22] Filed: May 11, 1994

[30] Foreign Application Priority Data

May 17, 1993 [JP] Japan ..... 5-114605

[51] Int. Cl.[6] ..... F41B 11/06

[52] U.S. Cl. ..... 124/73; 124/74; 124/75

[58] Field of Search ..... 124/73, 72, 71, 124/70, 69, 74, 75, 76, 56, 31

[56] References Cited

U.S. PATENT DOCUMENTS

| | | | |
|---|---|---|---|
| 2,566,181 | 8/1951 | Fitch | 124/70 X |
| 2,881,752 | 4/1959 | Blahnik | 124/75 |
| 5,063,905 | 11/1991 | Farrell | 124/74 X |
| 5,280,778 | 1/1994 | Kotsiopoulos | 124/73 |

FOREIGN PATENT DOCUMENTS

| | | | |
|---|---|---|---|
| 341408 | of 1959 | Germany | 124/74 |
| 1285798 | 11/1989 | Japan | 124/72 |
| 338593 | 4/1991 | Japan | 124/72 |
| 3221793 | 9/1991 | Japan | 124/72 |
| 3236598 | 10/1991 | Japan | 124/71 |
| 58285 | 2/1993 | Japan . | |

*Primary Examiner*—Eric K. Nicholson
*Assistant Examiner*—Harry C. Kim
*Attorney, Agent, or Firm*—Sixbey, Friedman, Leedom & Ferguson; Gerald J. Ferguson, Jr.; David S. Safran

[57] ABSTRACT

A model gun with automatic bullet supplying mechanism comprises a slider provided to be movable along a barrel, a movable member provided between a bullet holding chamber provided at the back of the barrel and a pressure chamber with variable capacity provided in the slider, and a gas passage controller provided to be movable in the movable member. The gas passage controller is operative selectively to control a first gas passage extending from a pressure accumulating chamber through the movable member to the bullet holding chamber to be open so that gas discharged from the pressure accumulating chamber is supplied through the first gas passage to the bullet holding chamber and to control a second gas passage extending from the pressure accumulating chamber through the movable member to the pressure chamber to be open so that gas discharged from the pressure accumulating chamber is supplied through the second gas passage to the pressure chamber to cause each of the slider and the movable member to move back for making preparations for supplying the bullet holding chamber with a sham bullet from a magazine for containing sham bullets.

4 Claims, 19 Drawing Sheets

71
71b
27

71
71b
71c
27
71d
71e
71a 71
71a
27

72
72b
27

72
72b
27
72c
72a 72
27
72a 73
73b
73c
27
73c 73
73c
73b
27
73c
73a 73
27
73a

MODEL GUN WITH AUTOMATIC BULLET SUPPLYING MECHANISM

BACKGROUND OF THE INVENTION

1. Field of the Invention

The present invention relates generally to a model gun with automatic bullet supplying mechanism, and more particularly to an improvement in a model gun having an automatic bullet supplying mechanism which is operative to supply automatically a bullet holding chamber provided just at the back of a barrel with a sham bullet which is to be shot with gas pressure.

2. Description of the Prior Art

A model gun which is often called an air soft gun is made to imitate a real gun in not only its color and shape but also its apparent operations. As for one of these model guns, which is made to imitate a real gun having a slider provided to be able to move back and forward along a barrel thereof in accordance with triggering action, it has been proposed to make such an arrangement that gas pressure is used for supplying a bullet holding chamber provided just at the back of a barrel with a sham bullet and further for shooting the sham bullet put in the bullet holding chamber, as shown in, for example, Japanese patent application published before examination under publication number 3-38593. According to the arrangement thus proposed, a pressure accumulating bomb in which compressed air is contained and which has an air leading passage controlled to be open and closed selectively by an operation valve, a magazine for containing sham bullets, first and second valves, first and second air passages and a bullet supplying lever are provided in a grip, an air cylinder is positioned in a slider which is provided to be able to move back and forward along a barrel to be opposite to the rear end of the barrel with a magazine plate between, and a rotary cam engaging with the magazine plate to move the same upward and downward and a spring guide member which moves together with the slider are further provided, so that each of the sham bullets contained in the magazine is supplied to the inside of the barrel and then shot through the barrel with the compressed air discharged from the pressure accumulating bomb.

In a model gun to which the above mentioned arrangement is applied, when a trigger is pulled, the first valve is caused to operate for permitting the compressed air discharged through the air leading passage opened by the operation valve from the pressure accumulating bomb to be introduced through the first air passage into the inside of the air cylinder and a piston provided in the air cylinder is moved with the pressure of the compressed air to cause the slider to move back. The air cylinder is shifted into the air exhausting condition after the slider has moved back to a predetermined position. The spring guide member also moves back together with the .slider to compress a spring member and thereby the rotary cam is rotated to move the magazine plate downward. A bullet holding hole formed on the magazine plate is positioned to be opposite to the sham bullet if the sham bullet is pushed out of the magazine for containing sham bullets when the magazine plate is moved downward, Then, the sham bullet which has been pushed out of the magazine for containing sham bullets is put in the bullet holding hole on the magazine plate by the bullet supplying lever moved together with the trigger.

After that, when the slider returns to the initial position under a condition wherein the air is exhausted from the air cylinder, the spring member is operative to return the spring guide member to the initial position thereof and therefore the rotary cam is rotated to move the magazine plate upward so that the bullet holding hole on the magazine plate in which the sham bullet-is put is moved to the initial position to be opposite to the rear end of the barrel. When the magazine plate holding the sham bullet in the bullet holding hole formed thereon has reached the initial position, the second valve is caused to operate for permitting the compressed air discharged through the air leading passage opened by the operation valve from the pressure accumulating bomb to be introduced through the second air passage into the bullet holding hole formed on the magazine plate by a hammer which rotates with the movement of the trigger and the sham bullet put in the bullet holding hole is shot through the barrel with the compressed air introduced into the bullet holding hole.

With the previously proposed model gun in which the air cylinder is provided to form a pressure chamber in the slider which is provided to be movable along the barrel and the sham bullet is supplied to the bullet holding hole formed on the magazine plate by supplying the pressure chamber with the compressed air and discharging the compressed air from the pressure chamber as described above, it is possible to shoot a plurality of sham bullets continuously under the automatic bullet supplying operation. However, since an air passage controller which comprises a plurality of valves and is operative to supply the pressure chamber and the bullet holding hole formed on the magazine plate selectively with the compressed air discharged from the pressure accumulating bomb is provided in the grip and therefore a distance from the air passage controller to each of the pressure chamber and the bullet holding hole is relatively long, each of the air passage extending from the pressure accumulating bomb to the pressure chamber and the air passage extending from the pressure accumulating bomb to the bullet holding hole is so complicated in its construction. Further, the consumption of compressed air discharged from the pressure accumulating bomb is undesirably increased.

OBJECTS AND SUMMARY OF THE INVENTION

Accordingly, it is an object of the present invention to provide a model gun with automatic bullet supplying mechanism, in which a bullet holding chamber to which a sham bullet is supplied to be shot with gas pressure is provided just at the back of a barrel and a pressure chamber operative to supply the bullet holding chamber with the sham bullet by using gas pressure supplied thereto is provided in a slider which is provided to be movable along the barrel, and which avoids the aforementioned disadvantages encountered with the prior art.

Another object of the present invention is to provide a model gun with automatic bullet supplying mechanism, in which a bullet holding chamber to which a sham bullet is supplied to be shot with gas pressure is provided just at the back of a barrel and a pressure chamber operative to supply the bullet holding chamber with the sham bullet by using gas pressure supplied thereto is provided in a slider which is provided to be movable along the barrel, and which has a gas passage controller provided for supplying the pressure chamber and the bullet holding chamber selectively with compressed gas discharged from a pressure accumulating chamber and located at such a position that each of a gas passage extending from the pressure accumulating chamber to the pressure chamber and a gas passage extending from the pressure accumulating chamber to the bullet holding chamber can be simplified in its construction.

A further object of the present invention is to provide a model gun with automatic bullet supplying mechanism, in which a bullet holding chamber to which a sham bullet is supplied to be shot with gas pressure is provided just at the back of a barrel and a pressure chamber operative to supply the bullet holding chamber with the sham bullet by using gas pressure supplied thereto is provided in a slider which is provided to be movable along the barrel, and by which gas consumption required to supply the bullet holding chamber with the sham bullet and then to shoot the sham bullet in the bullet holding chamber through the barrel can be reduced effectively.

According to the present invention, there is provided a model gun with automatic bullet supplying mechanism, which comprises a magazine for containing sham bullets provided in a grip, a pressure accumulating chamber provided in the grip for accumulating gas pressure, a bullet holding chamber provided just at the back of a barrel to be close to one end of the magazine, a slider provided to be movable along the barrel, a pressure chamber with variable capacity provided in the slider to be positioned at the back of the barrel, a movable member provided between the bullet holding chamber and the pressure chamber, and a gas passage controller provided to be movable in the movable member for controlling each of a first gas passage extending from the pressure accumulating chamber through the movable member to the bullet holding chamber and a second gas passage extending from the pressure accumulating chamber through the movable member to the pressure chamber to be open and closed selectively, wherein the gas passage controller is operative selectively to control the first gas passage to be open so that gas discharged from the pressure accumulating chamber is supplied through the first gas passage to the bullet holding chamber and to control the second gas passage to be open so that gas discharged from the pressure accumulating chamber is supplied through the second gas passage to the pressure chamber to cause each of the slider and the movable member to move back for making preparations for supplying the bullet holding chamber with the sham bullet from the end of the magazine.

In the model gun thus constituted in accordance with the present invention, the gas passage controller operative to control each of the first gas passage extending from the pressure accumulating chamber provided in the grip through the movable member to the bullet holding chamber and the second gas passage extending from the pressure accumulating chamber through the movable member to the pressure chamber with variable capacity to be open and closed selectively is provided in the movable member which is positioned above the grip between the bullet holding chamber and the pressure chamber. Since the gas passage controller is provided in the movable member positioned above the grip in which the pressure accumulating chamber is provided in such a manner as mentioned above, portions of the first and second gas passages in the grip are formed to be common to the first and second gas passages and a distance from the gas passage controller to each of the bullet holding chamber and the pressure chamber is made relatively short so that each of portions of the first and second gas passages in the movable member is shortened. Consequently, each of the first and second gas passages is shortened in its entirety and relatively simplified in its construction, and the consumption of the gas discharged from the pressure accumulating chamber, which is required to supply the bullet holding chamber with the sham bullet and then to shoot the sham bullet in the bullet holding chamber through the barrel, is effectively reduced.

In addition, since the portions of the first and second gas passages in the grip are formed to be common to the first and second gas passages and relatively simplified in construction, it is easily achieved to modify the pressure accumulating chamber so as to have enlarged capacity in the grip. Further, since the consumption of the gas discharged from the pressure accumulating chamber is effectively reduced and therefore the gas pressure in the pressure accumulating chamber is gently reduced, various portions operating with the gas discharged from the pressure accumulating chamber, such as the slider, can be smoothly moved for a relatively long time after the pressure accumulating chamber is charged with the gas.

The above, and other objects, features and advantages of the present invention will became apparent from the following detailed description taken in conjunction with the accompanying drawings.

DESCRIPTION OF THE PREFERRED EMBODIMENTS

Figure 1:
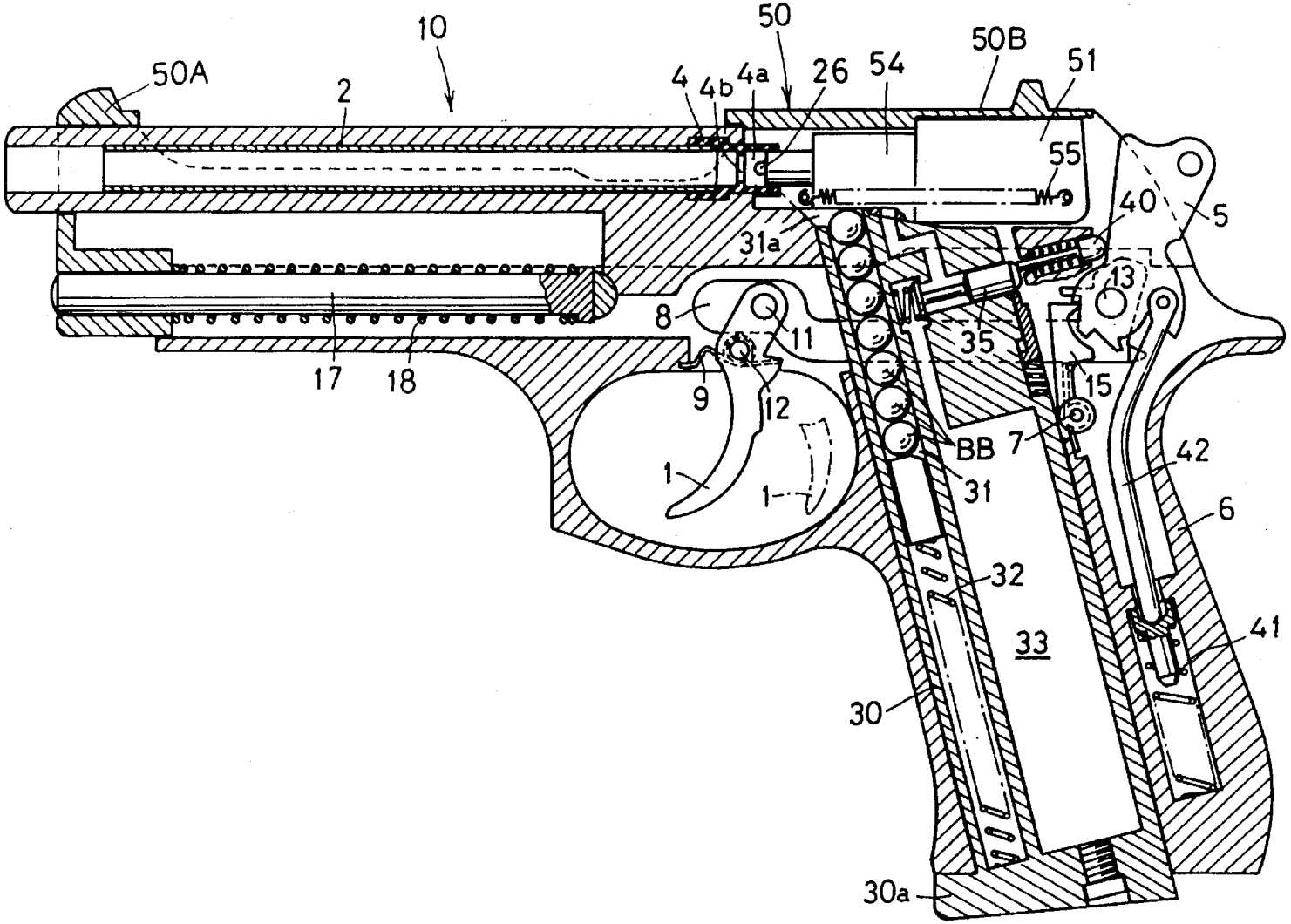
FIG. 1 is a schematic cross sectional view showing an embodiment of model gun with automatic bullet supplying mechanism according to the present invention.
Figure 2:
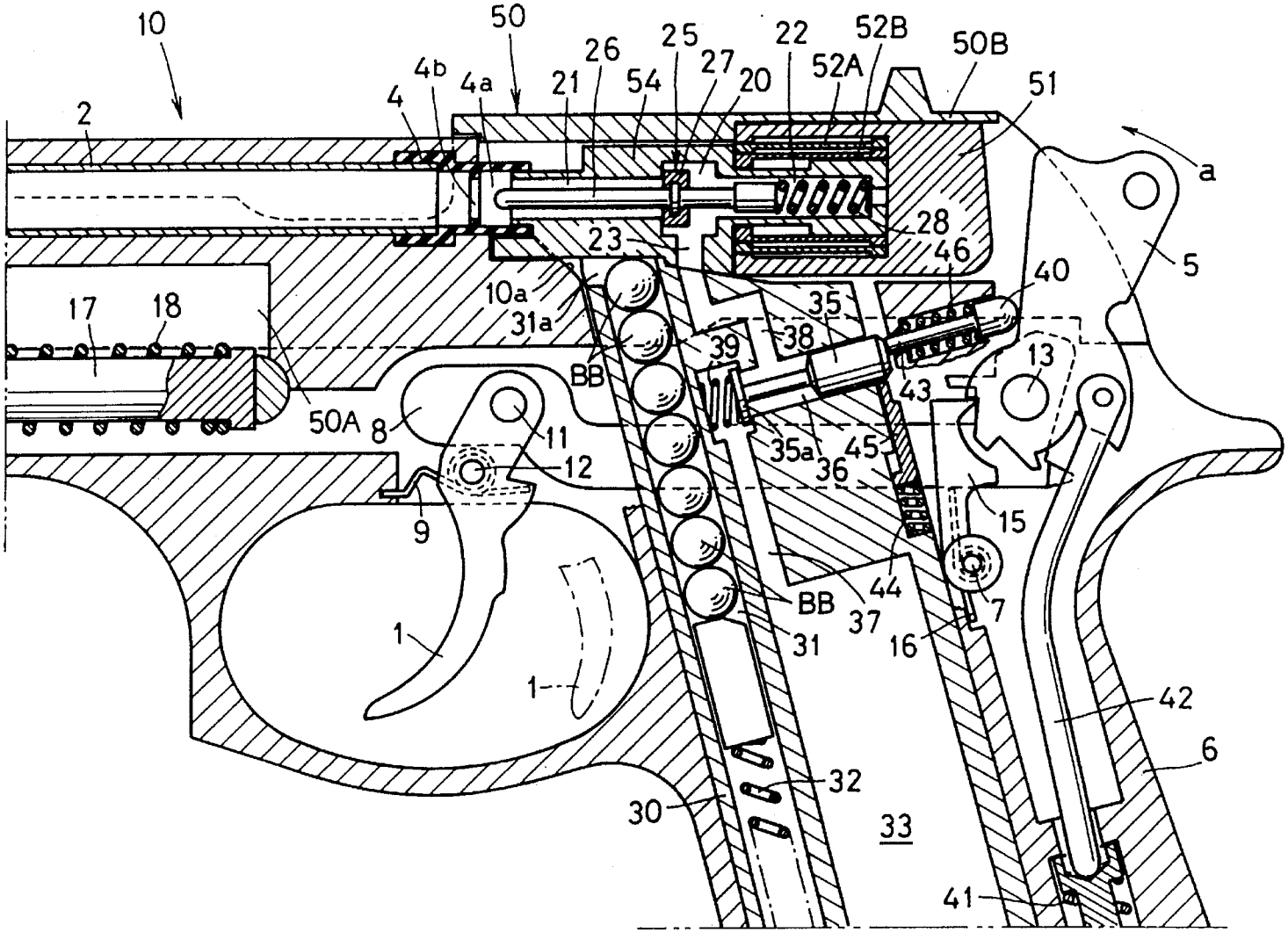
FIG. 2 is a schematic cross sectional view showing essential portions of the embodiment shown in FIG. 1.

FIGS. 1 and 2 show an embodiment of model gun with automatic bullet supplying mechanism according to the present invention.

Referring to FIG. 1, the embodiment has a body 10 in which a trigger 1, a barrel 2, a bullet holding chamber 4*a* positioned just at the back of the barrel 2, a hammer 5 and grip 6 are provided, a case 30 held to be detachable in the grip 6, and a slider 50 provided to be movable along the barrel 2. The bullet holding chamber 4*a* is formed in a rear portion of a tubular member 4 made of elastic frictional material, such as rubber. A front portion of the tubular member 4 is coupled with a rear end portion of the barrel 2. The tubular member 4 has a ring projection 4*b* provided on the inner surface to partition the rear and front portions.

A movable bar member 8 is provided in the grip 6 and the trigger 1 is attached to be rotatable to the body 10 with an axis 12 and a toggle spring 9 and connected with an axis 11 standing on a front portion of the movable bar member 8, which projects outward from the grip 6. When triggering, the trigger 1 is rotated on the axis 12 against the elastic force by the toggle spring 9 from a reference position as shown with a solid line in FIG. 1 to a finishing position as shown with a dot-dash line in FIG. 1. A rotary lever 15 attached with an axis 7 to the grip 6 is provided at the rear portion of the movable bar member 8, and the movable bar member 8 is moved to go forward and back in accordance with the rotations of the trigger 1 and rotated on the axis 1 in accordance with the movements of the slider 50 to cause the rotary lever 15 to rotate.

The slider 50 has a front portion 50A and a rear portion 50B which is incorporated with the front portion 50A to be positioned at the back of the barrel 2 and is attached to be movable to a portion of the body where the barrel 2 is provided. When the trigger 1 is put in the reference position, a front end of the front portion 50A of the slider 50 is positioned to be close to a front end of the body 10 and the rear portion 50B of the slider 50 is positioned to cover a mid portion of the body 10 between the barrel 2 and the grip 6, as shown in FIG. 1. The front portion 50A of the slider 50 is also engaged with a guide member 17 which extends along the barrel 2 in front of the trigger 1. The guide member 17 is provided with a coil spring 18 which is concerned through the guide member 17 with the front portion 50A of the slider 50 and is operative to exert the elastic force to the front portion 50A to put the same in tendency of moving forward.

In the rear portion 50B of the slider 50, as shown in FIG. 2, a pressure chamber portion which comprises a cup-shaped fixed member 51 and first and second movable tubular members 52A and 52B is provided. The cup-shaped fixed member 51 is secured to the rear portion 50B of the slider 50 for supporting the first and second movable tubular members 52A and 52B. When the slider 50 is put in a reference position, the second movable tubular member 52B is inserted in the first movable tubular member 52A and the first movable tubular member 52A is inserted in the cup-shaped fixed member 51.

Further, in the rear portion 50B of the slider 50, a movable member 54 is also provided. The movable member 54 is positioned between the bullet holding chamber 4*a* and the pressure chamber portion and has a rear portion put in the second movable tubular member 52B to form an engaging portion to the second movable tubular member 52B, a front portion which is coupled selectively with the rear portion of the tubular member 4 in which the bullet holding chamber 4*a* is formed, and a mid portion having a relatively large diameter. The movable member 54 is supported through the second movable tubular member 52B by the slider 50. A coil spring 55 is provided with one end attached to the cup-shaped fixed member 51 and the other end attached to the movable member 54 for exerting the elastic force to the movable member 54 to put the same in tendency of moving toward the cup-shaped fixed member 51. When the slider 50 is put in the reference position, the movable member 54 is put in such a position as to cause the front portion thereof to be coupled with the rear portion of the tubular member 4 in which the bullet holding chamber 4*a* is formed.

The movable member 54 is provided therein with a center space 20, a bullet shooting gas passage 21 extending from the center space 20 toward a front end of the movable member 54, a bullet supplying gas passage 22 extending from the center space 20 toward a rear end of the movable member 54, and a common gas passage 23 extending from the center space 20 toward the grip 6. Further, a gas passage controller 25 is also provided in the movable member 54 and a connecting passage having a relatively small diameter is formed at a rear end of the bullet supplying gas passage 22.

The gas passage controller 25 is constituted by a rod 26 extending from the bullet supplying gas passage 22 through the center space 20 and the bullet shooting gas passage 21 to the bullet holding chamber 4*a* and a valve 27 mounted on the rod 26 to be put in the center space 20, as shown in FIG. 2. The rod 26 constituting the gas passage controller 25 is pushed toward the bullet holding chamber 4*a* by a coil spring 28 which is put in the bullet supplying gas passage 22 to exert the elastic force to the rod 26. The valve 27 constituting the gas passage controller 25 is provided in the form of an elastic sealing ring member and operative to move between the bullet shooting gas passage 21 and the bullet supplying gas passage 22 in accordance with the movements of the rod 26 for controlling each of the bullet shooting gas passage 21 and the bullet supplying gas passage 22 to be open and closed selectively.

Figure 3C:
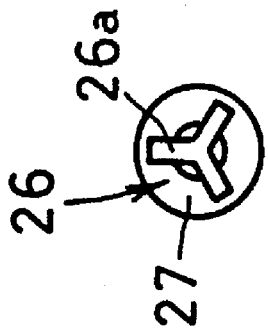
FIG. 3A, 3B and 3C are front, side and rear views respectively showing an example of a rod constituting a gas passage controller used in the embodiment shown in FIGS. 1 and 2.
Figure 3B:
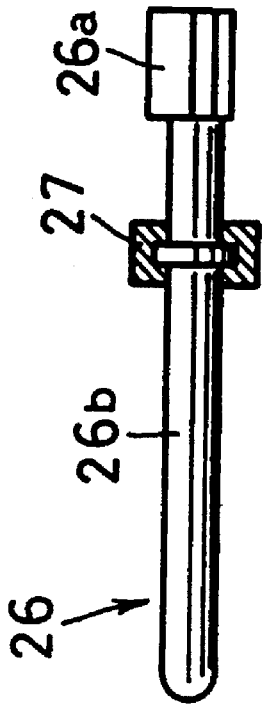
Figure 3A:
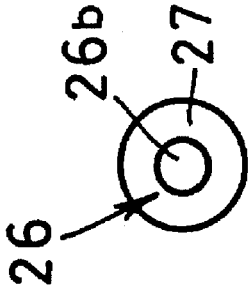

As shown in FIGS. 3A, 3B and 3C, the rod 26 constituting the gas passage controller 25 has a rear portion 26*a* having a cross section of the trifurcate shape and a sol-id body portion 26*b* having a front end of semi-spherical shape. The rear portion 26*a* is put in the bullet supplying gas passage 22 and the solid body portion 26*b* extends from the rear portion 26*a* toward the bullet holding chamber 4*a*. The valve 27 is mounted on the solid body portion 26*b*.

The hammer 5 is attached to be rotatable with an axis 13 to a rear end of the body 10. In an initial condition wherein the case 30 is inserted into the grip 6, the hammer 5 is positioned, for example, to be in contact with a rear end of a movable pin 40 projecting from the grip 6 and to engage with the rotary lever 15. The movable pin 40 is pushed toward the hammer 5 with the elastic force by a coil spring 46 which is put on a rod 43 extending from the movable pin 40 to exert the elastic force to the movable pin 40. The rotary lever 15 is forced to rotate to be close to the hammer 5 by a toggle spring 16 provided on the axis 7 for exerting the elastic force to the hammer 5. One end portion of a rod member 42, which has the other end portion engaging with a coil spring 41 provided in a lower portion of the grip 6, is connected to the hammer 5 and thereby the hammer 5 is forced to rotate in a direction indicated by an arrow a in FIG. 2 ( a direction) by the coil spring 41.

The case 30 is inserted into the grip 6 through an opening provided at a lower end portion of the grip 6 and a bottom portion 30*a* of the case 30 is engaged with the lower end portion of the grip 6 so that the case 30 is held in the grip 6.

The case 30 is provided therein with a magazine 31 for containing sham bullets BB, in which a coil spring 32 is provided for pushing the sham bullets BB toward an upper end portion 31*a* of the magazine 31, a pressure accumulating chamber 33 which is charged with, for example, liquefied gas, a connecting gas passage 36 in which a piston 35 is put to be movable for making one end portion of the connecting gas passage 36 closed, a lower gas passage 37 connecting the connecting gas passage 36 to the pressure accumulating chamber 33, and an upper gas passage 38 connected through the connecting gas passage 36 to the lower gas passage 37. The piston 35 put in the connecting gas passage 36 has a valve portion 35a operative to make the other end portion of the connecting gas passage 36 open and closed selectively in accordance with the movements thereof in the connecting gas passage 36. The piston 35 is pushed toward the outside of the case 30 by a coil spring 39 which is put in the lower gas passage 37 for exerting the elastic force to the piston 35.

In the condition wherein the case 30 is held in the grip 6 in such a manner as shown in FIGS. 1 and 2, the upper end portion 31*a* of the magazine 31 is positioned to be close to the bullet holding chamber 4*a* and closed by the mid portion of the movable member 54. Therefore, the sham bullets BB contained in the magazine 31 are pushed against the elastic force by the coil spring 32. One end portion of the piston 35 projects from the case 30 into the grip 6 to come into contact with the rod 43 extending from the movable pin 40 and to push a movable lever 45 in the grip 6 downward against the elastic force by a coil spring 44 by which the movable lever 45 is put in tendency of moving upward. Further, the upper gas passage 38 is coupled with the common gas passage 23 in the movable member 54 and the other end portion of the connecting gas passage 36 is closed by the valve portion 35*a* of the piston 35.

Figure 4:
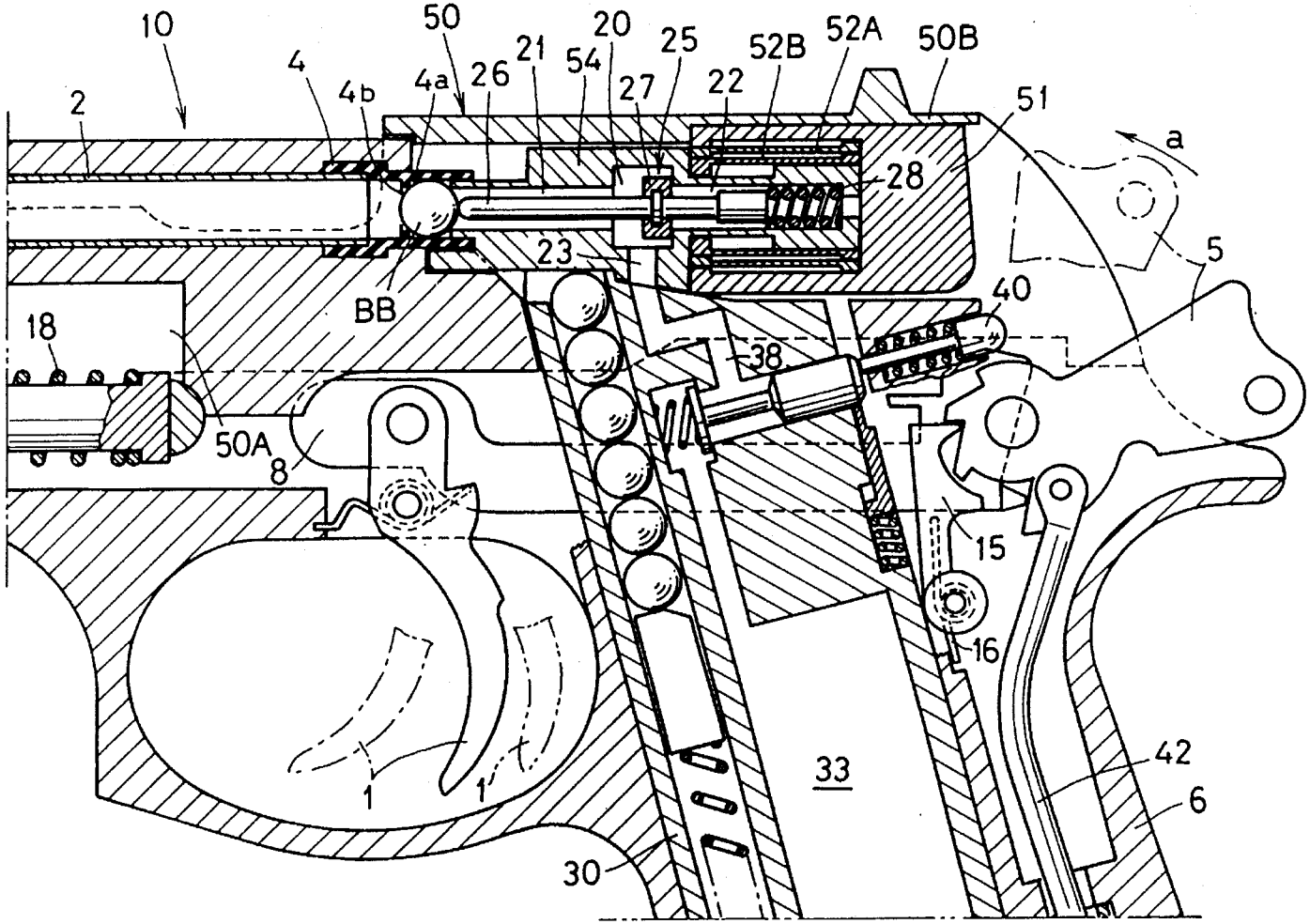
FIGS. 4, 5, 6, 7, 8 and 9 are schematic cross sectional views used for explaining the operation of the embodiment shown in FIGS. 1 and 2.

In the embodiment shown in FIGS. 1 and 2 and thus constituted, after the case 30 has been held in the grip 6, the slider 50 is once moved back manually from the reference position and then released to return to the reference position with the elastic force by the coil spring 18. During such movements of the slider 50, the movable member 54 which has its mid portion making the upper end portion 31*a* of the magazine 31 closed is moved back with the backward movement of the slider 50, so that the upper end portion 31*a* of the magazine 31 is made open and one of the sham bullets BB at the top in the magazine 31 is pushed up into the upper end portion 31*a* of the magazine 31 to be held therein by the coil spring 32. Then, the movable member 54 is moved forward with the forward movement of the slider 50 so as to cause the front portion thereof to come into the upper end portion 31*a* of the magazine 31 and to carry the sham bullet BB in the upper end portion 31*a* of the magazine 31 along a slope 10*a* formed in the body 10 to the bullet holding chamber 4*a*. On that occasion, the movable member 54 is operative further to cause the mid portion thereof to make the upper end portion 31*a* of the magazine 31 closed again and to cause the front portion thereof to be coupled again with the rear portion of the tubular member 4 in which the bullet holding chamber 4*a* is formed. As a result, the sham bullet BB is supplied to the bullet holding chamber 4*a* as shown in FIG. 4. The sham bullet BB in the bullet holding chamber 4*a* is appropriately held by the ring projection 4*b* provided in the tubular member 4 and the front portion of the movable member 54 coupled with the rear portion of the tubular member 4.

The sham bullet BB held in the bullet holding chamber 4*a* is in contact with the front end of the rod 26 constituting the gas passage controller 25 in the movable member 54 and thereby the rod 26 is pushed against the elastic force by the coil spring 28. Consequently, the valve 27 mounted on the rod 26 is so positioned as to make the bullet supplying gas passage 22 closed and to cause the bullet shooting gas passage 21 to be connected through the center space 20 and the common gas passage 23 to the upper gas passage 38 provided in the case 30.

Further, when the slider 50 is moved back, the hammer 5 is rotated by the cup-shaped fixed member 51, which moves back together with the slider 50, from the position shown with a dot-dash line in FIG. 4 against the elastic force by the coil spring 41 in a direction opposite to the a direction and pushes the rotary lever 15 against the elastic force by the toggle spring 16. Then, the hammer 5 engages with the rotary lever 15 at the position distant by a predetermined short distance from the movable pin 40 to be fixed in position, as shown with a solid line in FIG. 4. On that occasion, the trigger 1 is once rotated from the reference position shown with a dot-dash line in FIG. 4 to the finishing position shown with a double dot-dash line in FIG. 4 by the movable bar member 8 in accordance with the backward movement of the slider 50 and then rotated reversely from the finishing position to a waiting position as shown with a solid line in FIG. 4 by the movable bar member 8 in accordance with the forward movement of the slider 50 for returning to the reference position.

After the slider 50 has returned to the reference position, when the trigger 1 is pulled to rotate from the waiting position shown with the solid line in FIG. 4 toward the finishing position shown with the double dot-dash line in FIG. 4, the movable bar member 8 is moved forward in accordance with the rotating movement of the trigger 1. During the forward movement of the movable bar member 8, an engaging projection 8*a* provided on the rear portion of the movable bar member 8 causes the rotary lever 15 to rotate against the elastic force by the toggle spring 16 and an engaging projection 8*b* provided on the rear portion of the movable bar member 8 engages with a top end portion of the movable lever 45, as shown in FIG. 5.

Figure 5:
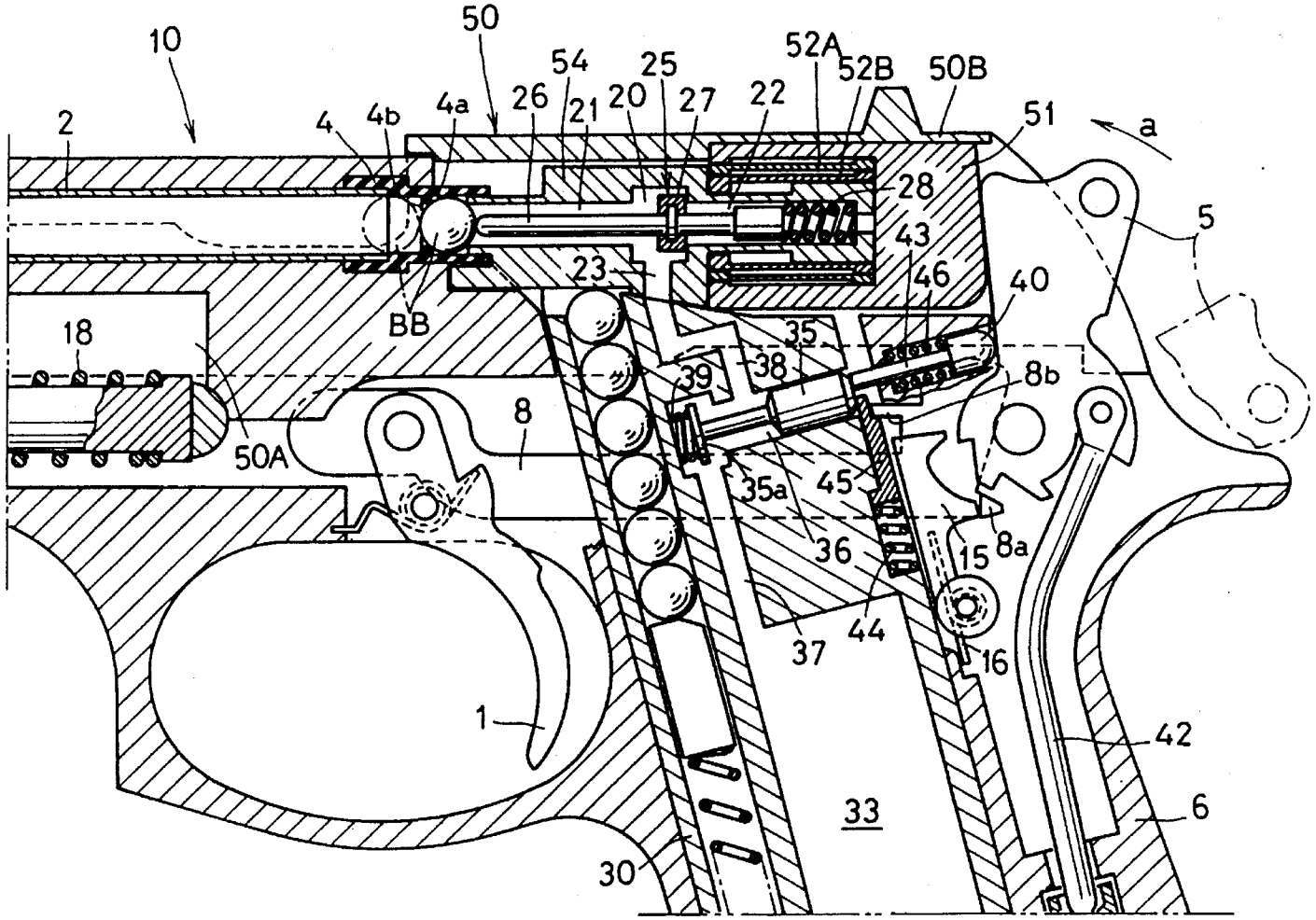

The hammer 5 is disengaged from the rotary lever 15 due to the forward movement of the movable bar member 8 and rotated by the coil spring 41 in the a direction from the position distant by the predetermined short distance from the movable pin 40, as shown with a dot-dash line in FIG. 5, to strike the movable pin 40 and then come into contact with the rear end of the cup-shaped fixed member 51 at substantially the same time at which the trigger 1 reaches the finishing position. The movable pin 40 which is struck by the hammer 5 is pushed against the elastic force by the coil spring 46 and the piston 35 is pushed by the rod 43 extending from the movable pin 40 against the elastic force by the coil spring 39. The piston 35 thus pushed allows the movable lever 45 to be moved upward by the coil spring 44. The movable lever 45 pushed upward prevents the piston 35 from moving to the outside of the case 30 by the coil spring 39 to be so positioned in the connecting gas passage 36 that the valve portion 35*a* of the piston 35 makes the other end portion of the connecting gas passage 36 open.

Under such a situation, the bullet shooting gas passage 21 which is made open by the valve 27 constituting the gas passage controller 25 is connected with the pressure accumulating chamber 33 in the case 30 and therefore the gas discharged from the pressure accumulating chamber 33 is supplied through the bullet shooting gas passage 21 to the bullet holding chamber 4*a*. Consequently, the sham bullet BB which is held in the bullet holding chamber 4*a* as shown with a solid line in FIG. 5 is caused by the pressure of the gas supplied to the bullet holding chamber 4*a* to pass-over the ring projection 4*b* provided in the tubular member 4 and to move into the front portion of the tubular member 4, as shown with a dot-dash line in FIG. 5. The pressure of the gas from the pressure accumulating chamber 33 acting on the valve 27 which is making the bullet supplying gas passage 22 closed is operative to prevent the rod 26 to be moved by the coil spring 28 and therefore the valve 27 is kept in the position for making the bullet supplying gas, passage 22 closed. When the sham bullet BB in the front portion of the tubular member 4 is further moved into the barrel 2 by the pressure of the gas from the pressure accumulating chamber 33, the gas leaks through a relatively small gap formed between the sham bullet BB and the inner surface of the barrel 2 into the barrel 2. With the gas thus leaking into the barrel 2, the speed of the sham bullet BB moving toward a front end of the barrel 2 is accelerated and the pressure of the gas in the center space 20 is reduced.

Figure 6:
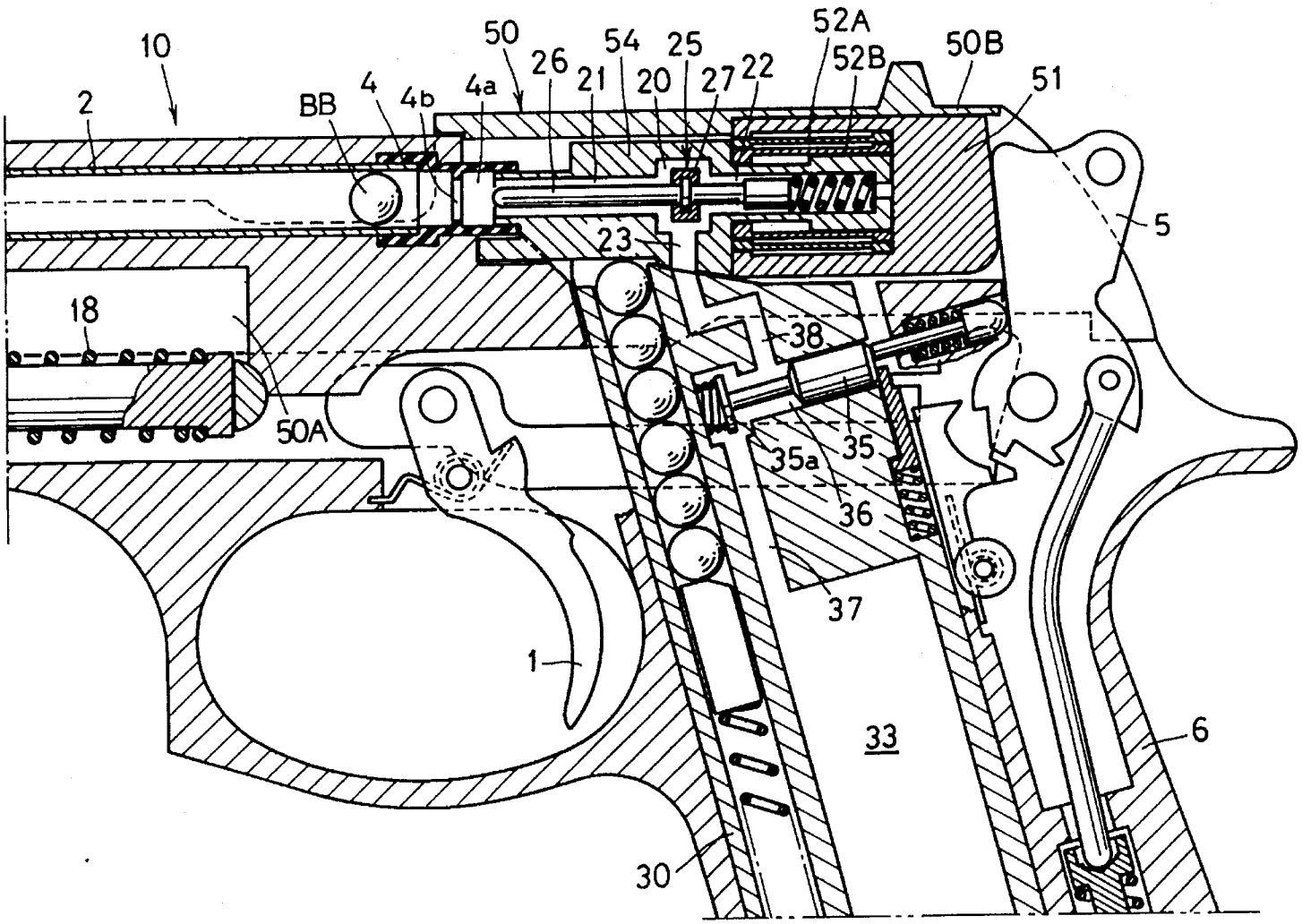
Figure 7:
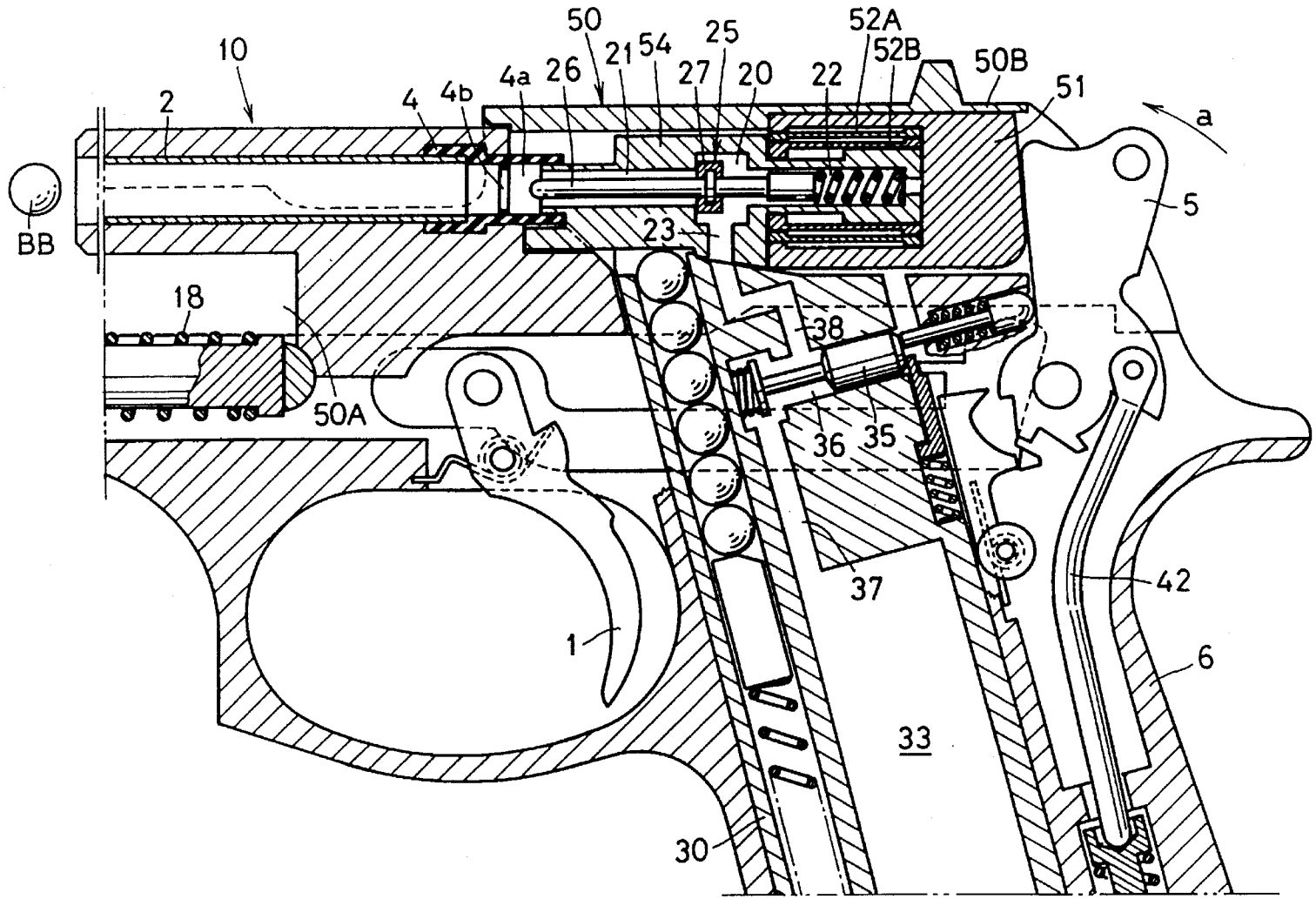

With the reduction in the pressure of the gas in the center space 20, the rod 26 is moved forward by the coil spring 28 and the valve 27 is moved from the bullet supplying gas passage 22 toward the bullet shooting gas passage 21, as shown in FIG. 6. The sham bullet BB moving in the barrel 2 is shot from the barrel 2 before the valve 27 reaches to the position for making the bullet shooting gas passage 21 closed, as shown in FIG. 7.

When the valve 27 is put in the position for making the bullet shooting gas passage 21 closed and the bullet supplying gas passage 22 is connected through the center space 20 and the common gas passage 23 with the upper gas passage 38 provided in the case 30, the pressure of the gas supplied from the pressure accumulating chamber 33 to the bullet supplying gas passage 22 is applied through the connecting passage provided to extend from the rear end of the bullet supplying gas passage 22 to the inner surface of the cup-shaped fixed member 51 for pushing the same to go away from the movable member 54. With the pressure of the gas supplied from the pressure accumulating chamber 33 into the cup-shaped fixed member 51, the slider 50 is moved back against the elastic force by the coil spring 18, the first movable tubular member 52A is projected from the cup-shaped fixed member 51 toward the tubular member 4, the second movable tubular member 52B is projected from the first movable tubular member 52A toward the tubular member 4. Further, the hammer 5 is rotated by the cup-shaped fixed member 51 moving back together with the slider 50 in the direction opposite to the a direction against the elastic force by the coil spring 41.

Figure 8:
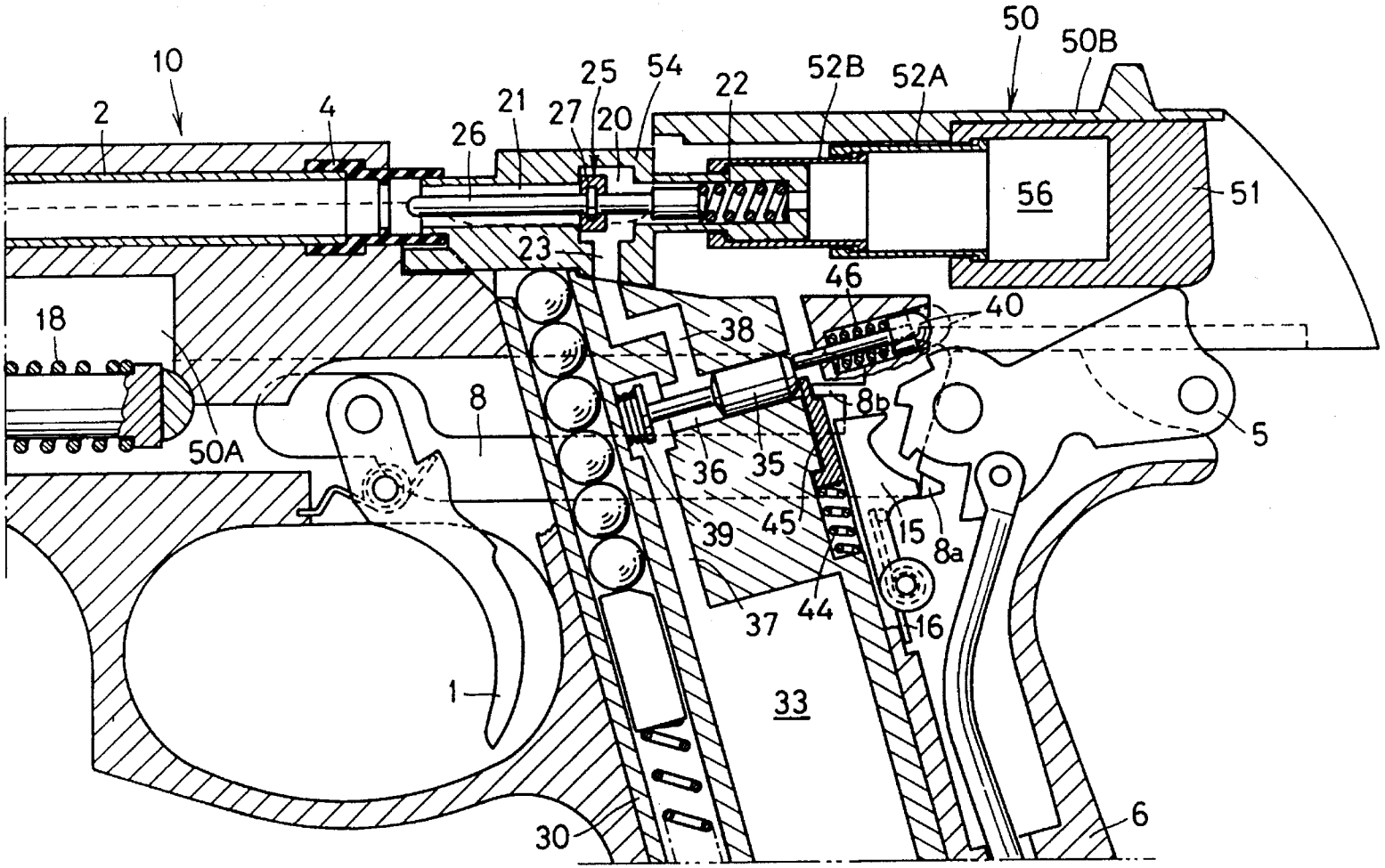

In this condition, a pressure chamber 56 having variable capacity, to which the gas discharged from the pressure accumulating chamber 33 is supplied through the bullet supplying gas passage 22, is formed in the pressure chamber portion comprising the cup-shaped fixed member 51 and the first and second movable tubular members 52A and 52B, as shown in FIG. 8. Further, the hammer 5 is put in the position distant from the movable pin 40 and the movable pin 40 is moved by the coil spring 46 from the position shown with the solid line in FIG. 8 to the position shown with the dot-dash line in FIG. 8 to project from the grip 6.

As described above, since the backward movement of the slider 50 is automatically started with the pressure of the gas supplied from pressure accumulating chamber 33 through the bullet supplying gas passage 22 to the inside of the cup-shaped fixed member 51, namely, the pressure chamber 56 having variable capacity, after the sham bullet BB has been shot from the barrel 2, the movements of the slider 50 do not exert any bad influence on the barrel 2 at the shooting of the sham bullet BB and therefore the direction of the sham bullet BB shot from the barrel 2 is properly set without being undesirably varied.

Figure 9:
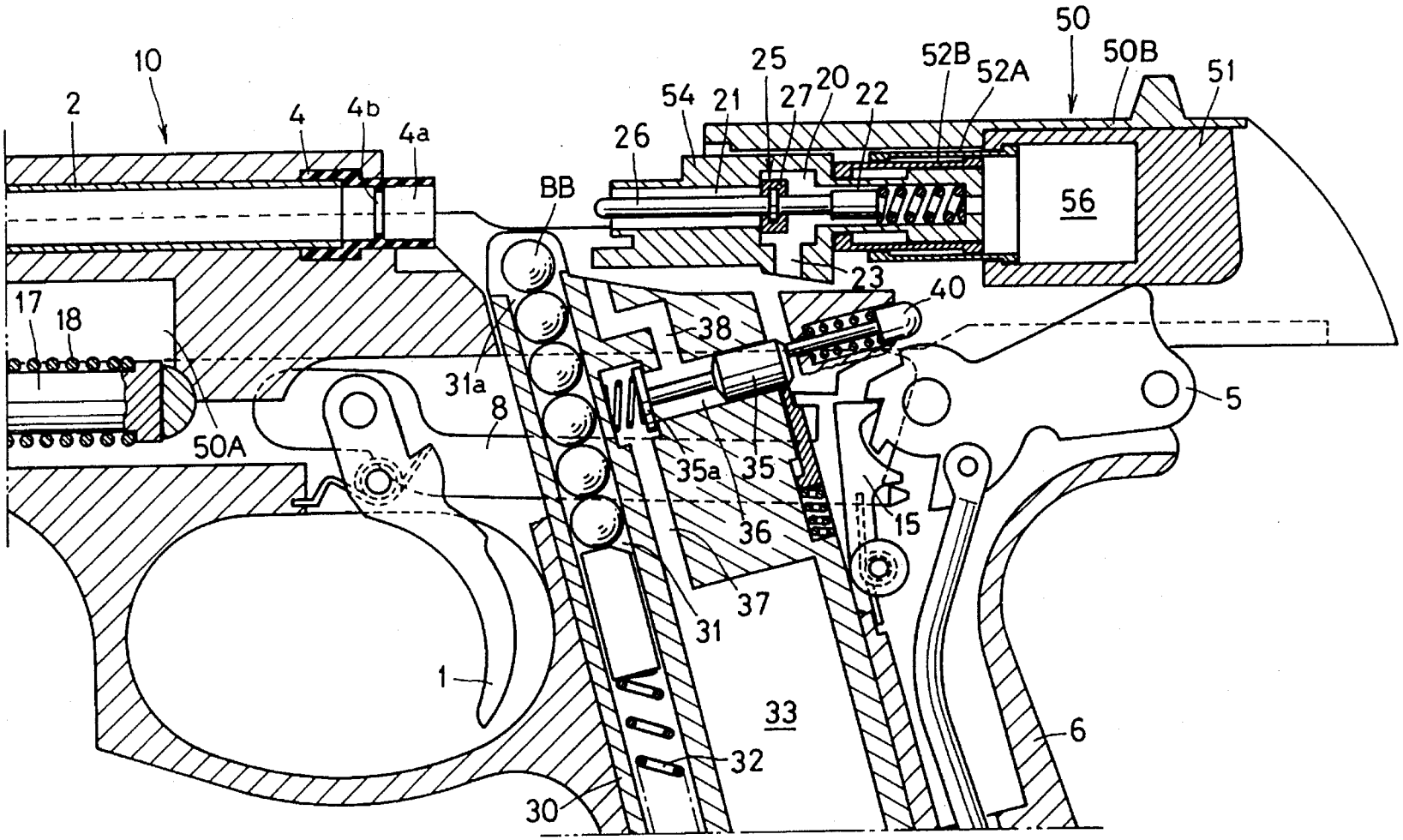
Figure 10:
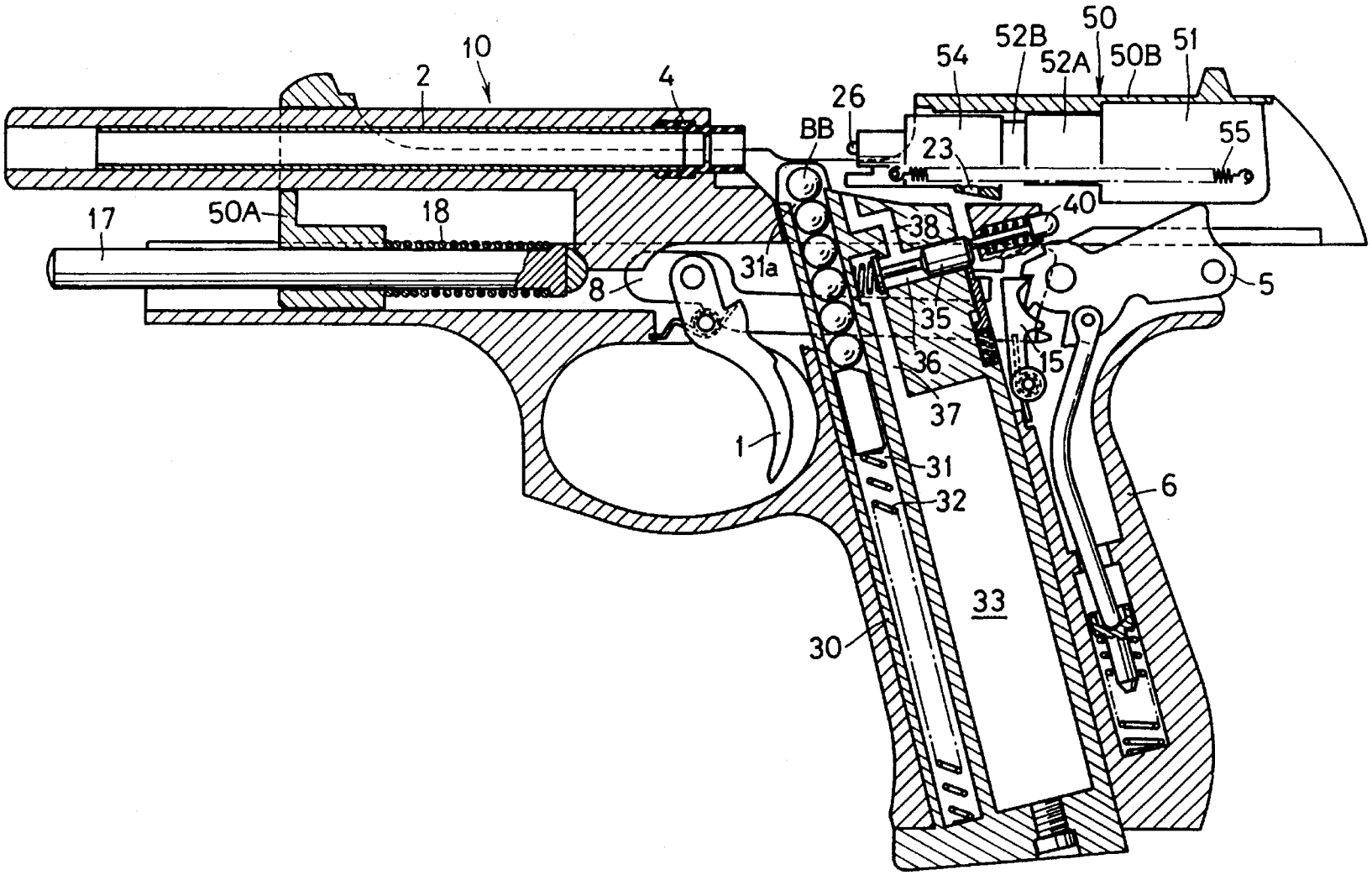
FIG. 10 is a schematic cross sectional views used for explaining the operation of the embodiment shown in FIGS. 1 and 2.

When the slider 50 is further moved back with the pressure of the gas supplied from the pressure accumulating chamber 33 to the pressure chamber 56, the movable bar member 8 is rotated to cause the rear portion thereof to go downward by the lower end of the rear portion 50B of the slider 50. The engaging projection 8*a* provided on the rear portion of the movable bar member 8 is disengaged from the rotary lever 15 and the rotary lever 15 is rotated by the toggle spring 16 to come into contact with the hammer 5. Further, the movable lever 45 engaging with the engaging projection 8*b* provided on the rear portion of the movable bar member 8 is pushed downward by the coil spring 44 and the piston 35 is released from the positional restriction by the movable lever 45 and moved by the coil spring 39 to the position for projecting from the case 30. Consequently, as shown in FIGS. 9 and 10, the hammer 5 is kept in the position distant from the movable pin 40 by the rotary lever 15, and the valve portion 35*a* of the piston 35 is positioned to make the other end of the connecting gas passage 36 closed so that the supply of the gas from the pressure accumulating chamber 33 to the pressure chamber 56 is stopped.

After the supply of the gas from the pressure accumulating chamber 33 to the pressure chamber 56 has been stopped, tile slider 50 is further moved back with the force of inertia. Then, just before the slider 50 has been reached to the rearmost position, the first and second movable tubular members 52A and 52B have the longest projection length from the cup-shaped fixed member 51 so that the pressure chamber 56 has the largest capacity and the front end portion of the second movable tubular member 52B engages with the rear portion of the movable member 54. Accordingly, after that, the movable member 54 is moved back together with the slider 50 which is moved back with the force of inertia. As a result, the upper end portion 31*a* of the magazine 31 is made open and one of the sham bullets BB at the top in the magazine 31 is pushed up into the upper end portion 31*a* of the magazine 31 to be held therein. With the backward movement of the movable member 54, a space is formed between a lower end portion of the movable member 54 and an upper end portion of the case 30 and the common gas passage 23 provided in the movable member 54 is disconnected from the upper gas passage 38 provided in the case 30, so that the gas in the pressure chamber 56 is exhausted through the bullet supplying gas passage 22, the center space 20 and the common gas passage 23 to the atmosphere to reduce the pressure of the gas in the pressure chamber 56.

After the reduction in the pressure of the gas in the pressure chamber 56 has started, the movable member 54 is moved back by the coil spring 55 and the first and second movable tubular members 52A and 52B are gradually drawn into the cup-shaped fixed member 51. Then, when the slider 50 has been reached to the rearmost position, the first and second movable tubular members 52A and 52B has been completely put in the cup-shaped fixed member 51 and the movable member 54 has been so positioned as to cause the mid portion thereof to be in contact with the cup-shaped fixed member 51. Just after the slider 50 has been reached to the rearmost position, the slider 50 is moved forward by the coil spring 18 and the movable member 54 is also moved forward together with the slider 50. With such forward movement of the movable member 54, the front portion of the movable member 54 carries the sham bullet BB held in the upper end portion 31*a* of the magazine 31 toward the bullet holding chamber 4*a*.

When the slider 50 is put in the reference position again, the sham bullet BB is surely held in the bullet holding chamber 4*a* and the rod 26 constituting the gas passage controller 25 in the movable member 54 is moved back by the sham bullet BB held in the bullet holding chamber 4*a*, so that the valve 27 mounted on the rod 26 is so positioned as to make the bullet supplying gas passage 22 closed and to cause the bullet shooting gas passage 21 to be connected through the center space 20 and the common gas passage 23 to the upper gas passage 38 provided in the case 30, as shown in FIG. 4.

Under such a condition, when the trigger 1 is moved from the finishing position to the reference position, the movable bar member 8 is caused to return to the position where the movable bar member 8 was put before the trigger 1 was pulled. After that, when the trigger 1 is pulled again, the shooting of the sham bullet BB held in the bullet holding chamber 4*a* and the supply of a new sham bullet BB to the bullet holding chamber 4*a* are carried out in the same manner as that mentioned above.

As explained above, in the embodiment shown in FIG. 1, the gas passage controller 25 operative to control each of the bullet shooting gas passage 21 and the bullet supplying gas passage 22 to be open and closed selectively is provided in the movable member 54 which is positioned above the grip 6 between the bullet holding chamber 4*a* formed in the tubular member 4 and the pressure chamber portion comprising the cup-shaped fixed member 51 and the first and second movable tubular members 52A and 52B, the common gas passage 23, the upper gas passage 38, the connecting gas passage 36 and the lower gas passage 37, which form a single gas passage in its entirety, are used in common for each of the bullet shooting gas passage 21 and the bullet supplying gas passage 22, and a distance from the gas passage controller 25 to each of the bullet holding chamber 4*a* and the pressure chamber portion is made relatively short so that each of the bullet shooting gas passage 21 and the bullet supplying gas passage 22 is shortened. Consequently, each of the gas passage extending from the pressure accumulating chamber 33 through the movable member 54 to the bullet holding chamber 4*a* and the gas passage extending from the pressure accumulating chamber 33 through the movable member 54 to the pressure chamber 56 having variable capacity is shortened in its entirety and relatively simplified in its construction, and the consumption of the gas discharged from the pressure accumulating chamber 33, which is required to supply the bullet holding chamber 4*a* with the sham bullet BB and then to shoot the sham bullet BB in the bullet holding chamber 4*a* through the barrel 2, is effectively reduced.

In addition, since the upper gas passage 38, the connecting gas passage 36 and the lower gas passage 37 in the case 30 held in the grip 6 are formed to be common to the bullet shooting gas passage 21 and the bullet supplying gas passage 22 and relatively simplified in construction, it is easily achieved to modify the pressure accumulating chamber 33 so as to have enlarged capacity in the grip 6. Further, since the consumption of the gas discharged from the pressure accumulating chamber 33 is effectively reduced and therefore the pressure of the gas in the pressure accumulating chamber 33 is gently reduced, various portions operating with the gas discharged from the pressure accumulating chamber 33 can be smoothly moved for a relatively long time after the pressure accumulating chamber 33 is charged with the gas.

Although the pressure chamber portion comprises the cup-shaped fixed member 51 and the first and second movable tubular members 52A and 52B in the embodiment described above, the model gun with automatic bullet supplying mechanism according to the present invention is not limited to this embodiment. It is also possible for the model gun with automatic bullet supplying mechanism according to the present invention to have a pressure chamber portion which comprises only a cup-shaped fixed member or a cup-shaped fixed member and a movable tubular member.

Figure 11:
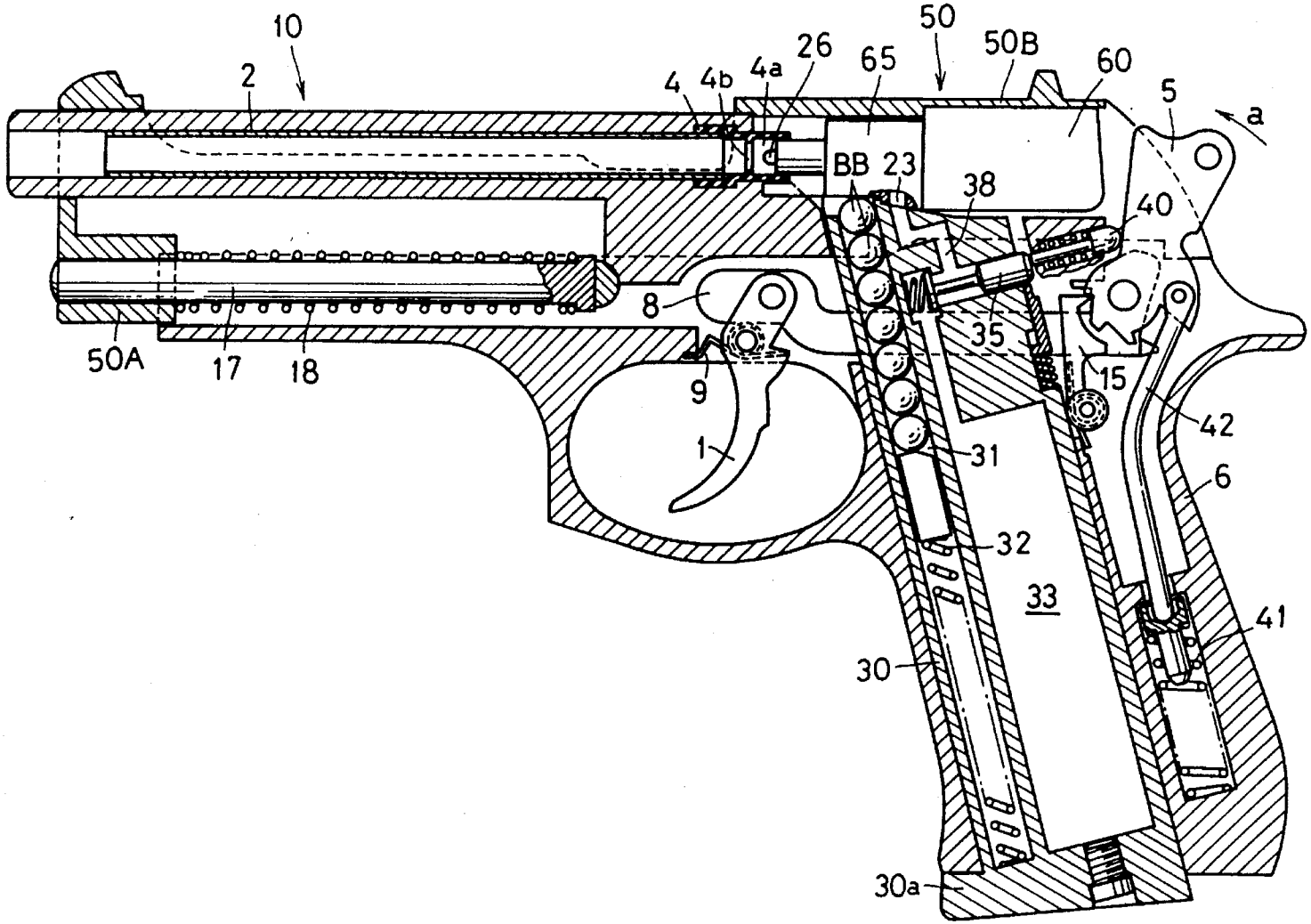
FIG. 11 is a schematic cross sectional view showing another embodiment of model gun with automatic bullet supplying mechanism according to the present invention.
Figure 12:
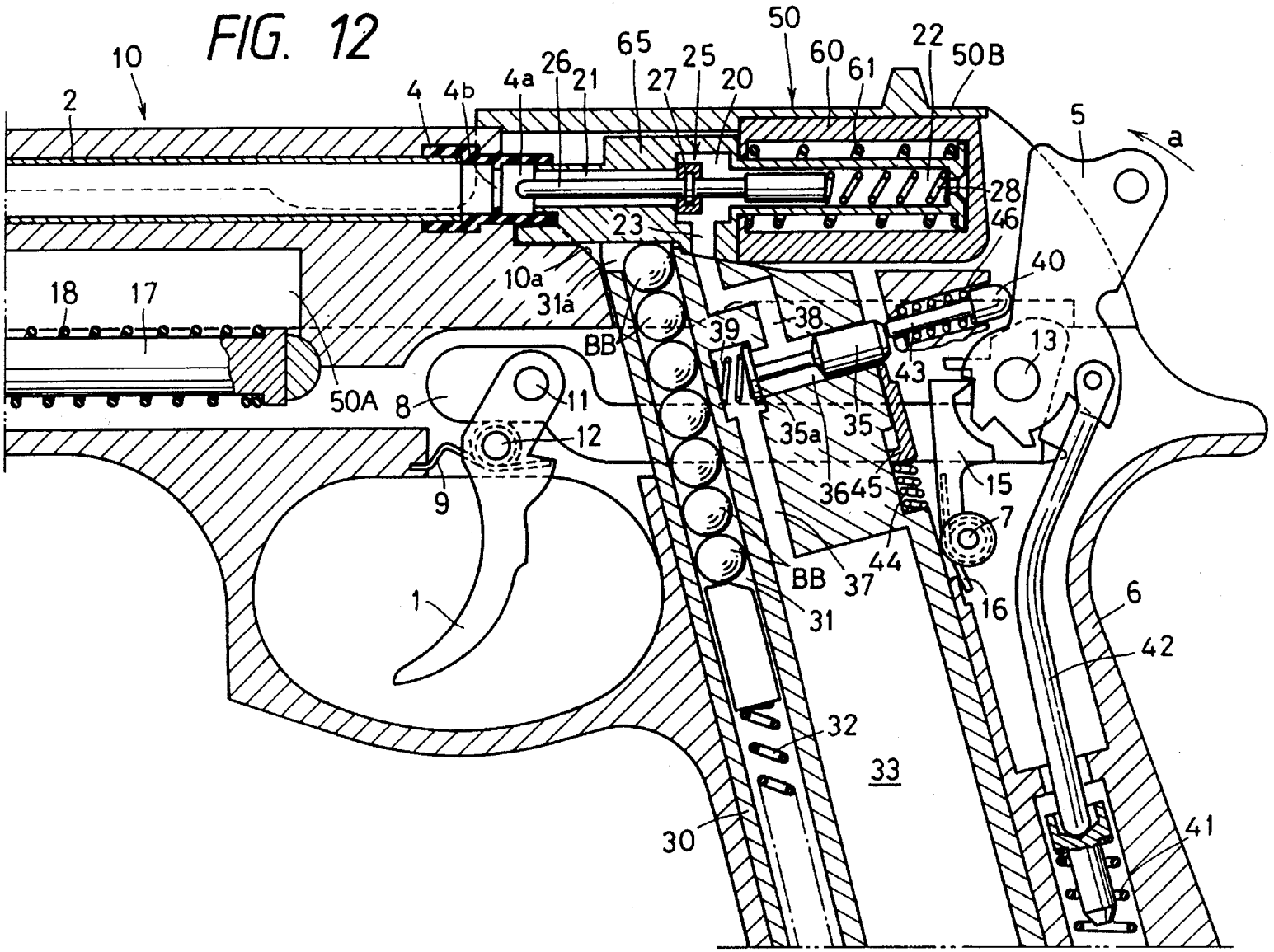
FIG. 12 is a schematic cross sectional view showing essential portions of the embodiment shown in FIG. 11.

FIGS. 11 and 12 show another embodiment of model gun with automatic bullet supplying mechanism according to the present invention. The embodiment shown in FIGS. 11 and 12 has a pressure chamber portion which is different from the pressure chamber portion in the embodiment shown in FIGS. 1 and 2, which comprises the cup-shaped fixed member 51 and the first and second movable tubular members 52A and 52B, and a movable member which is different from the movable member 54 in the embodiment shown in FIGS. 1 and 2. Portions other than the pressure chamber portion and the movable member of the embodiment shown in FIGS. 11 and 12 are substantially the same as the portions other than the pressure chamber portion and the movable member 54 of the embodiment shown in FIGS. 1 and 2. In FIGS. 11 and 12, parts and portions corresponding to those in FIGS. 1 and 2 are marked with the same references and further description thereof will be omitted.

Referring to FIGS. 11 and 12, in a rear portion 50B of a slider 50, a pressure chamber portion which comprises a cup-shaped fixed member 60 and a coil spring 61 put in the cup-shaped fixed member 60. Further, in the rear portion 50B of the slider 50, a movable member 65 is also provided between a bullet holding chamber 4*a* and the pressure chamber portion. The movable member 65 has a rear portion which is put in the cup-shaped fixed member 60 and on which the coil spring 63 is mounted, a front portion which is coupled selectively with a rear portion of a tubular member 4 in which the bullet holding chamber 4*a* is formed, and a mid portion having a relatively large diameter. The rear portion of the movable member 65 is provided at the rear end thereof with an engaging projection for engaging with the cup-shaped fixed member 60.

The movable member 65 is provided therein, in the same manner as the movable member 54 in the embodiment shown in FIGS. 1 and 2, with a center space 20, a bullet shooting gas passage 21, a bullet supplying gas passage 22, and a common gas passage 23. Further, a gas passage controller 25 is also provided in the movable member 54. The movable member 65 is supported through the cup-shaped fixed member 60 by the slider 50. When the slider 50 is put in a reference position, the movable member 65 is put in such a position that the mid portion thereof is in contact with the cup-shaped fixed member 60, the rear portion thereof is fully put in the cup-shaped fixed member 60 to stretch the coil spring 61 and the front portion thereof is coupled with the rear portion of the tubular member 4 in which the bullet holding chamber 4*a* is formed.

In the condition wherein a case 30 is held in a grip 6 in such a manner as shown in FIGS. 11 and 12, an upper end portion 31*a* of a magazine 31 provided in the case 30 is closed by the mid portion of the movable member 65. Therefore, sham bullets BB contained in the magazine 31 are pushed against the elastic force by a coil spring 32. Further, an upper gas passage 38 provided in the case 30 is coupled with the common gas passage 23 provided in the movable member 65.

In the embodiment shown in FIGS. 11 and 12 and thus constituted, after the case 30 has been held in the grip 6, the slider 50 is once moved back manually from the reference position and then released to return to the reference position with the elastic force by a coil spring 18. During such movements of the slider 50, a hammer 5 is rotated by the cup-shaped fixed member 60, which moves back together with the slider 50, in a direction opposite to the a direction and engages with a rotary lever 15 at a position distant by a predetermined short distance from a movable pin 40 to be fixed in position.

With the backward and forward movements of the slider 50 mentioned above, the movable member 65 is moved in the same manner as the movable member 54 shown in FIGS. 1 and 2 and thereby the upper end portion 31*a* of the magazine 31 is made open and closed selectively and one of the sham bullets BB held in the upper end portion 31*a* of the magazine 31 is carried to the bullet holding chamber 4*a* to be held therein. The sham bullet BB in the bullet holding chamber 4*a* is appropriately held by a ring projection 4*b* provided in the tubular member 4 and the front portion of the movable member 65 coupled with the rear portion of the tubular member 4, as shown in FIG. 13.

Figure 13:
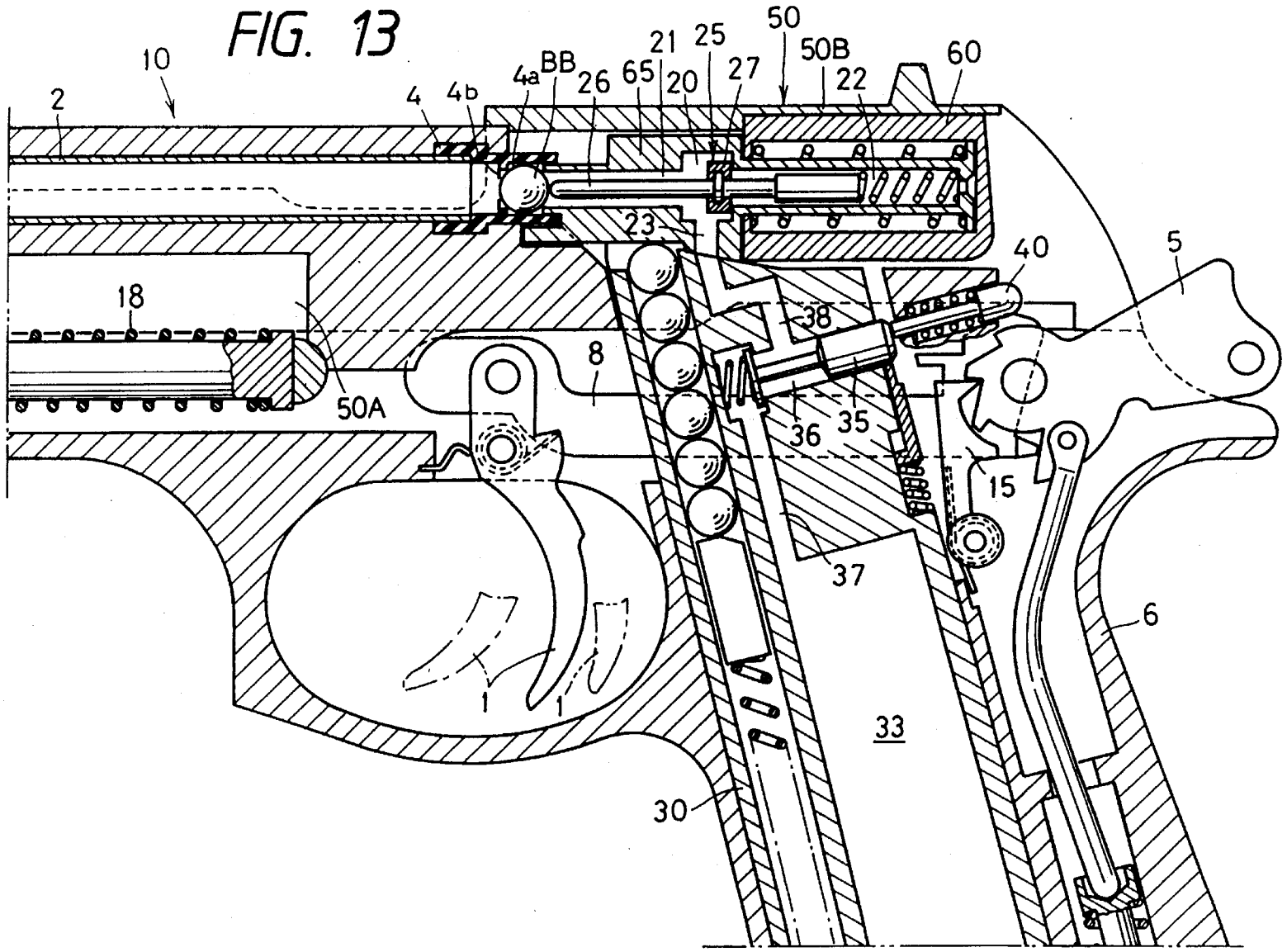
FIGS. 13, 14, 15, 16 and 17 are schematic cross sectional views used for explaining the operation of the embodiment shown in FIGS. 11 and 12.

In a condition wherein the sham bullet BB is surely held in the bullet holding chamber 4*a* as mentioned above, a rod 26 constituting the gas passage controller 25 in the movable member 65 is moved back by the sham bullet BB held in the bullet holding chamber 4*a*, so that a valve 27 mounted on the rod 26 is so positioned as to make the bullet supplying gas passage 22 closed and to cause the bullet shooting gas passage 21 to be connected through the center space 20 and the common gas passage 23 to the upper gas passage 38 provided in the case 30, as shown in FIG. 13.

Further, with the backward and forward movements of the slider 50, a trigger 1 is once rotated from a reference position shown with a dot-dash line in FIG. 13 to a finishing position shown with a double dot-dash line in FIG. 13 by a movable bar member 8 and then rotated reversely from the finishing position to a waiting position as shown with a solid line in FIG. 13 by the movable bar member 8.

Figure 14:
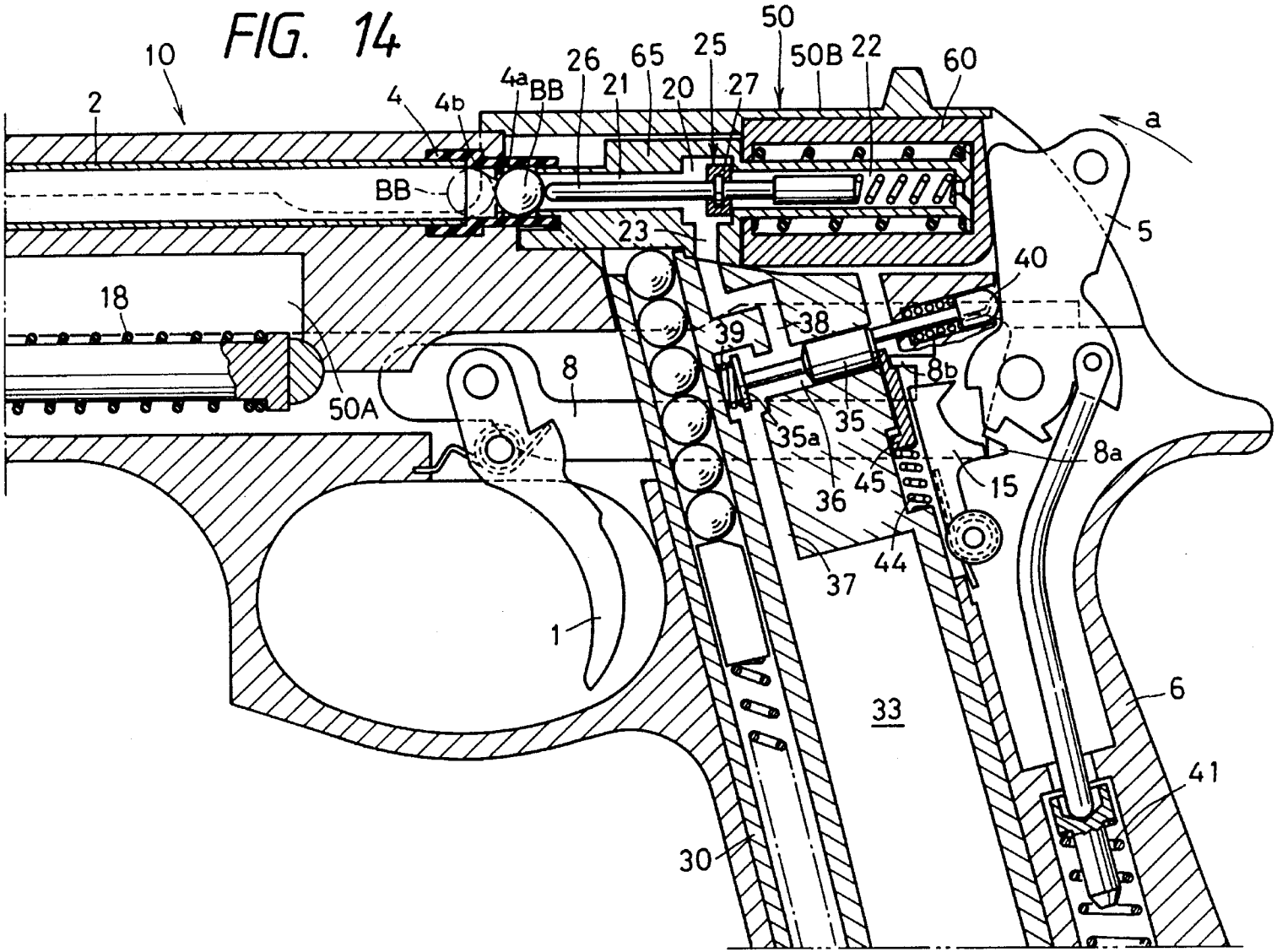
Figure 15:
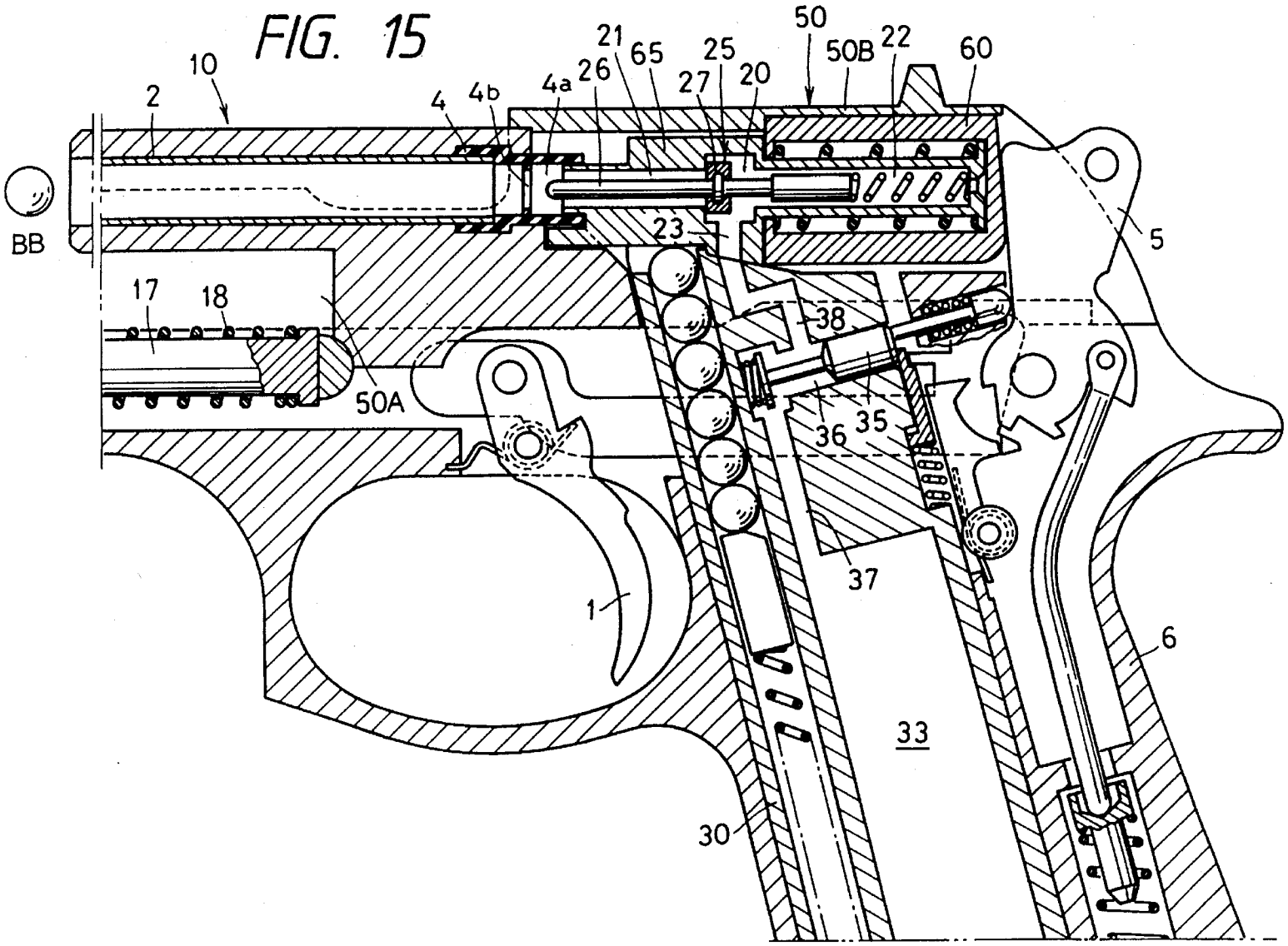

After the slider 50 has returned to the reference position the trigger 1 is pulled to rotate from the waiting position shown with the solid line in FIG. 13 toward the finishing position shown with the double dot-dash line in FIG. 13, the movable bar member 8 is moved forward in accordance with the rotating movement of the trigger 1. Thereby, the hammer 5 is rotated in the a direction from the position distant by the predetermined short distance from the movable pin 40 to strike the movable pin 40 and then come into contact with the rear end of the cup-shaped fixed member 60 at substantially the same time at which the trigger 1 reaches the finishing position, as shown in FIG. 14. With the movable pin 40 which is struck by the hammer 5, a piston 35 in a connecting gas passage 36 provided in the case 30 is so positioned that a valve portion 35*a* provided thereon makes one end portion of the connecting gas passage 36 open and gas discharged from a pressure accumulating chamber 33 provided in the case 30 is supplied through the bullet shooting gas passage 21 to the bullet holding chamber 4*a*. Consequently, the sham bullet BB which is held in the bullet holding chamber 4*a* as shown with a solid line in FIG. 14 is caused by the pressure of the gas supplied to the bullet holding chamber 4*a* to pass over the ring projection 4*b* provided in the tubular member 4 and move into a front portion of the tubular member 4, as shown with a dot-dash line in FIG. 14. The sham bullet BB moved into the front portion of the tubular member 4 is shot through a barrel 2 before the valve 27 reaches to the position for making the bullet shooting gas passage 21 closed, as shown in FIG. 15.

When the valve 27 is put in the position for making the bullet shooting gas passage 21 closed and the bullet supplying gas passage 22 is connected through the center space 20 and the common gas passage 23 with the upper gas passage 38 provided in the case 30, the pressure of the gas supplied from the pressure accumulating chamber 33 to the bullet supplying gas passage 22 is applied through the connecting passage provided to extend from the rear end of the bullet supplying gas passage 22 to the inner surface of the cup-shaped fixed member 60 for pushing the same to go away from the movable member 65. With the pressure of the gas supplied from the pressure accumulating chamber 33 into the cup-shaped fixed member 60, the slider 50 is moved back against the elastic force by the coil spring 18.

Figure 16:
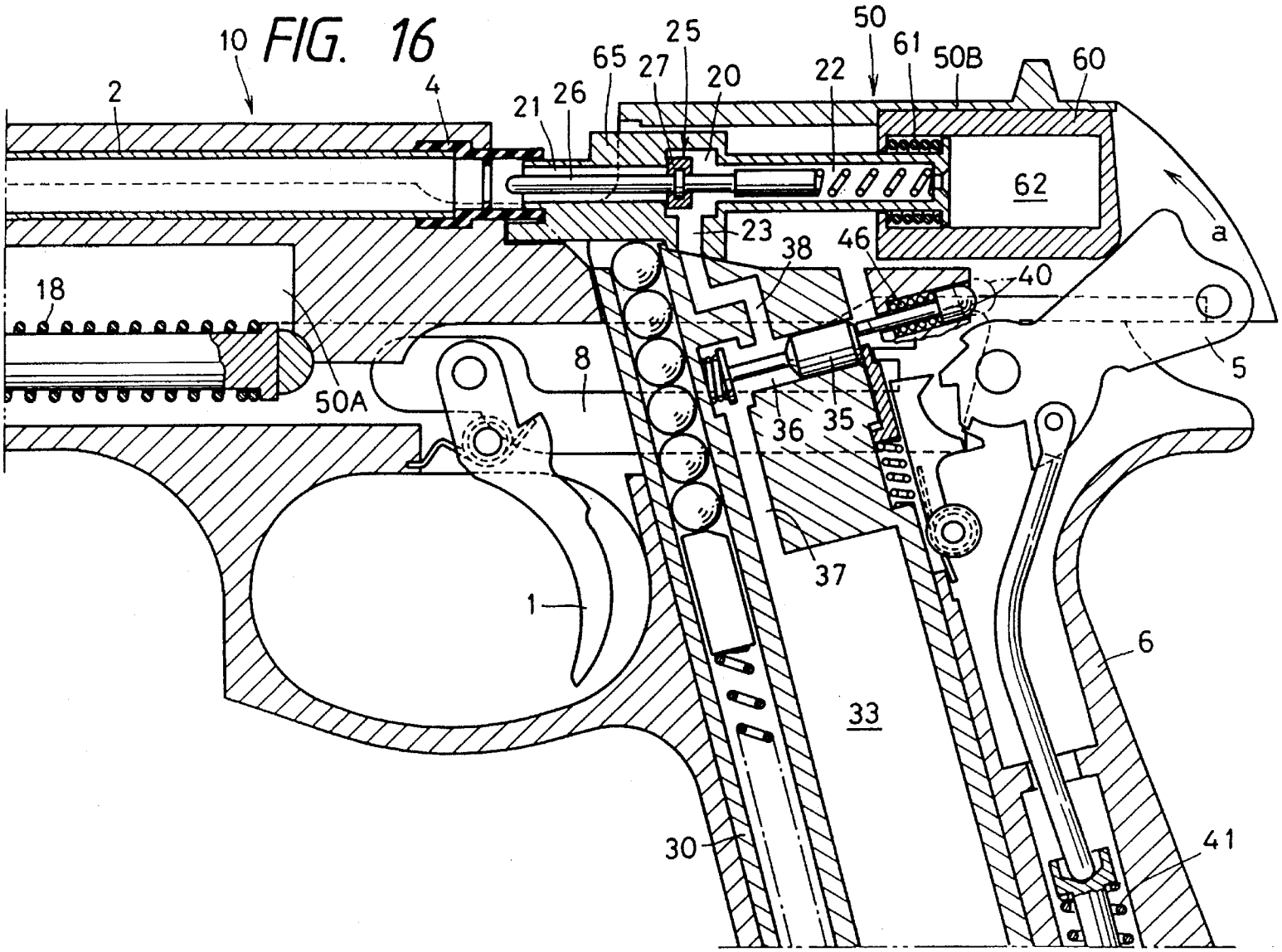

In this condition, a pressure chamber 62 having variable capacity, to which the gas discharged from the pressure accumulating chamber 33 is supplied through the bullet supplying gas passage 22, is formed in the cup-shaped fixed member 60 constituting the pressure chamber portion as shown in FIG. 16. On that occasion, with the pressure of the gas from the pressure accumulating chamber 33 acting on the valve 27 which is making the bullet supplying gas passage 22 closed, the movable member 65 is kept in the position for causing the front portion thereof to engage with the rear portion of the tubular member 4. Therefore, the cup-shaped fixed member 60 which moves back together with the slider 50 compresses the coil spring 61 and goes away from the mid portion of the movable member 65.

Further, the hammer 5 is rotated by the cup-shaped fixed member 60, which moves back together with the slider 50, in the direction opposite to the a direction against the elastic force by a coil spring 41. Then, the hammer 5 is put in the position distant from the movable pin 40 and the movable pin 40 is moved by a coil spring 46 from the position shown with the solid line in FIG. 16 to the position shown with the dot-dash line in FIG. 16 to project from the grip 6.

As described above, since the backward movement of the slider 50 is automatically started with the pressure of the gas supplied from pressure accumulating chamber 33 through the bullet supplying gas passage 22 to the inside of the cup-shaped fixed member 60, namely, the pressure chamber 62 having variable capacity, after the sham bullet BB has been shot from the barrel 2, the movements of the slider 50 do not exert any bad influence on the barrel 2 at the shooting of the sham bullet BB and therefore the direction of the sham bullet BB shot from the barrel 2 is properly set without being undesirably varied.

Figure 17:
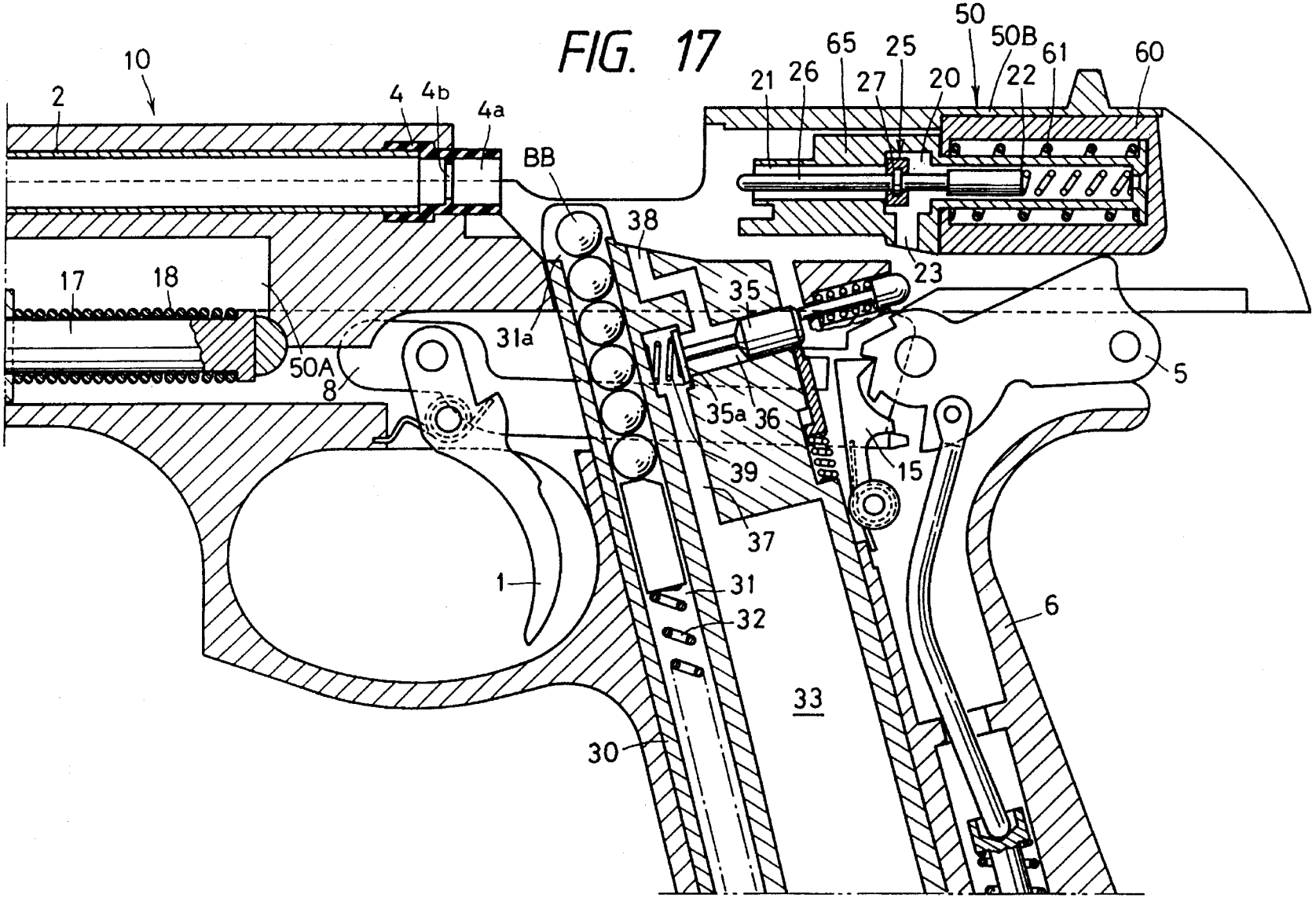
Figure 18:
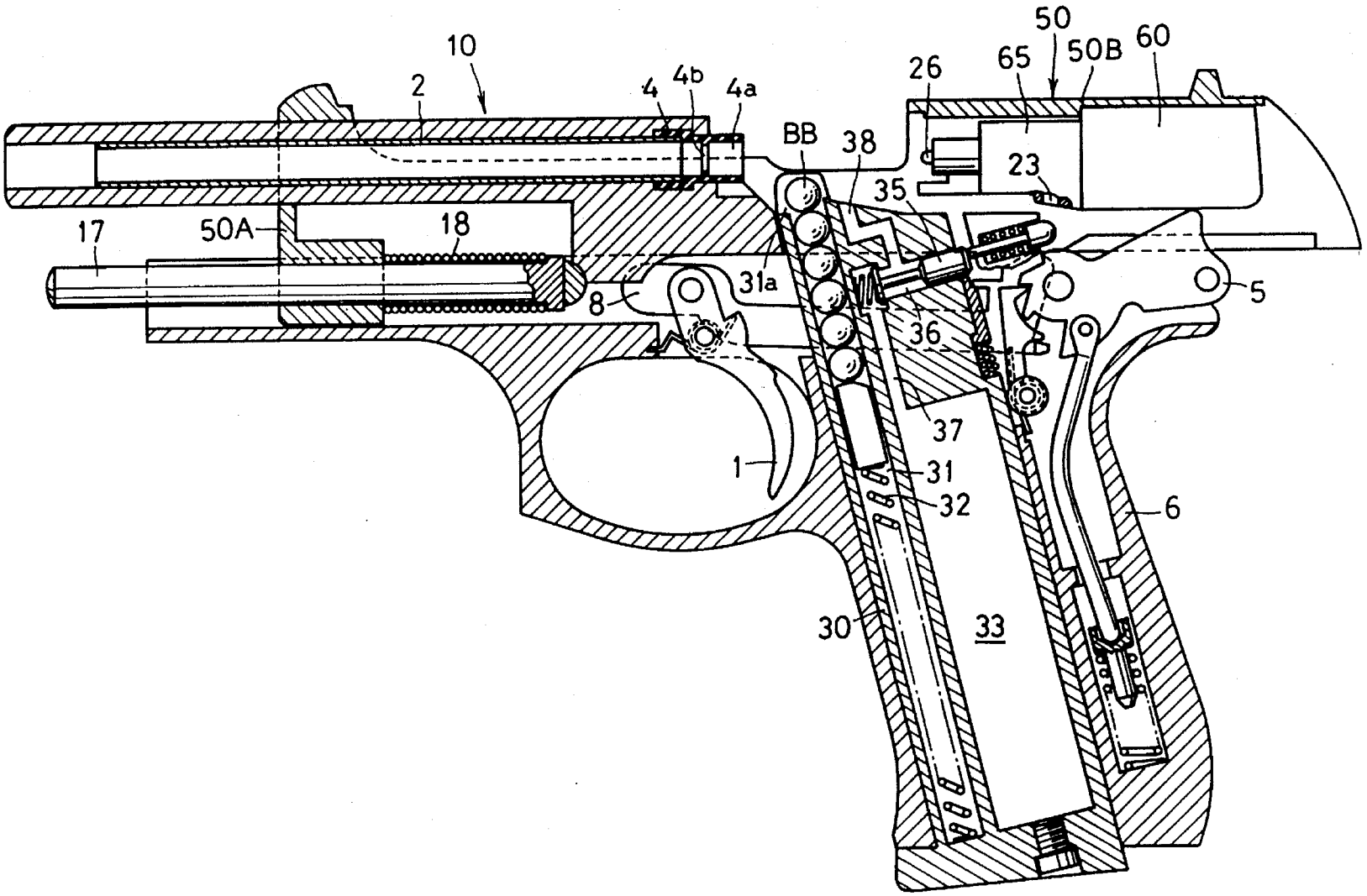
FIG. 18 is a schematic cross sectional views used for explaining the operation of the embodiment shown in FIGS. 11 and 12.

When the slider 50 is further moved back with the pressure of the gas supplied from the pressure accumulating chamber 33 to the pressure chamber 62, the movable bar member 8 is rotated to cause the hammer 5 to be kept in the position distant from the movable pin 40 by the rotary lever 15, and the valve portion 35*a* of the piston 35 is positioned to make one end of the connecting gas passage 36 closed so that the supply of the gas from the pressure accumulating chamber 33 to the pressure chamber 62 is stopped, as shown in FIGS. 17 and 18.

After the supply of the gas from the pressure accumulating chamber 33 to the pressure chamber 62 has been stopped, the slider 50 is further moved back with the force of inertia. Then, just before the slider 50 has been reached to the rearmost position, the coil spring 61 is most compressed by the cup-shaped fixed member 60, which moves back together with the slider 50, so that the pressure chamber 62 has the largest capacity, and the cup-shaped fixed member 60 engages through the coil spring 61 with the movable member 65. Accordingly, after that, the movable member 65 is moved back together with the slider 50 which is moved back with the force of inertia. As a result, the upper end portion 31*a* of the magazine 31 is made open and one of the sham bullets BB at the top in the magazine 31 is pushed up into the upper end portion 31*a* of the magazine 31 to be held therein. With the backward movement of the movable member 65, a space is formed between a lower end portion of the movable member 65 and an upper end portion of the case 30 and the common gas passage 23 provided in the movable member 65 is disconnected from the upper gas passage 38 provided in the case 30, so that the gas in the pressure chamber 62 is exhausted through the bullet supplying gas passage 22, the center space 20 and the common gas passage 23 to the atmosphere to reduce the pressure of the gas in the pressure chamber 62.

After the reduction in the pressure of the gas in the pressure chamber 62 has started, the coil spring 61 is turned into the stretched state and the movable member 65 is further moved back. Then, when the slider 50 has been reached to the rearmost position, the movable member 65 has been so positioned as to cause the mid portion thereof to be in contact with the cup-shaped fixed member 60. Just after the slider 50 has been reached to the rearmost position, the slider 50 is moved forward by the coil spring 18 and the movable member 65 is also moved forward together with the slider 50. With such forward movement of the movable member 65, the front portion of the movable member 65 carries the sham bullet BB held in the upper end portion 31*a* of the magazine 31 toward the bullet holding chamber 4*a*.

When the slider 50 is put in the reference position again, the sham bullet BB is surely held in the bullet holding chamber 4*a* and the rod 26 constituting the gas passage controller 25 in the movable member 65 is moved back by the sham bullet BB held in the bullet holding chamber 4*a*, so that the valve 27 mounted on the rod 26 is so positioned as to make the bullet supplying gas passage 22 closed and to cause the bullet shooting gas passage 21 to be connected with the upper gas passage 38 provided in the case 30, as shown in FIG. 13.

Under such a condition, when the trigger 1 is moved from the finishing position to the reference position, the movable bar member 8 is caused to return to the position where the movable bar member 8 was put before the trigger 1 was pulled. After that, when the trigger 1 is pulled again, the shooting of the sham bullet BB held in the bullet holding chamber 4*a* and the supply of a new sham bullet BB to the bullet holding chamber 4*a* are carried out in the same manner as that mentioned above.

As explained above, in the embodiment shown in FIGS. 11 and 12, since the gas passage controller 25 operative to control each of the bullet shooting gas passage 21 and the bullet supplying gas passage 22 to be open and closed selectively is provided in the movable member 65 which is positioned above the grip between the bullet holding chamber 4*a* formed in the tubular member 4 and the pressure chamber portion comprising the cup-shaped fixed member 60, the same advantages and effect as those obtained by the embodiment shown in FIGS. 1 and 2 can be obtained.

In the embodiment shown in FIGS. 11 and 12, when the movable member 65 moves back together with the slider 50, the coil spring 61 which is put on the rear portion of the movable member 65 is most compressed until the pressure of the gas in the pressure chamber 62 and then turned into the stretched state after the reduction in the pressure of the gas in the pressure chamber 62 has started so that the movable member 65 further moves back to cause the mid portion thereof to come into contact with the cup-shaped fixed member 60. However, the coil spring 61 is not always necessary for the model gun with automatic bullet supplying mechanism according to the present invention.

The reason for this is that, even if the coil spring 61 is not put on the rear portion of the movable member 65, the movable member 65 is able to move back continuously with the force of inertia so as to cause the mid portion thereof to come into contact with the cup-shaped fixed member 60 after the reduction in the pressure of the gas in the pressure chamber 62 has started under the condition of the backward movement of the movable member 65 in accordance with the backward movement of the slider 50. This fact has been confirmed by the inventor of the present invention. In the case where the coil spring 61 is put on the rear portion of the movable member 65 in such a manner as that in the embodiment shown in FIGS. 11 and 12, the reliability of the backward movement of the movable member 65 after the reduction in the pressure of the gas in the pressure chamber 62 has started is increased.

Although the rod 26 constituting the gas passage controller 25 is formed as shown in FIG. 3 in each of the embodiments shown in FIGS. 1 and 2 and FIGS. 11 and 12, respectively, one of rod 71, 72 and 73 shown in FIGS. 19A, 19B and 19C, FIGS. 20A, 20B and 20C and FIGS. 21A, 21B and 21C, respectively, can be used in place of the rod 26.

Figures 19A, 19B, 19C, 20A, 20B, 20C, 21A, 21B, 21C:
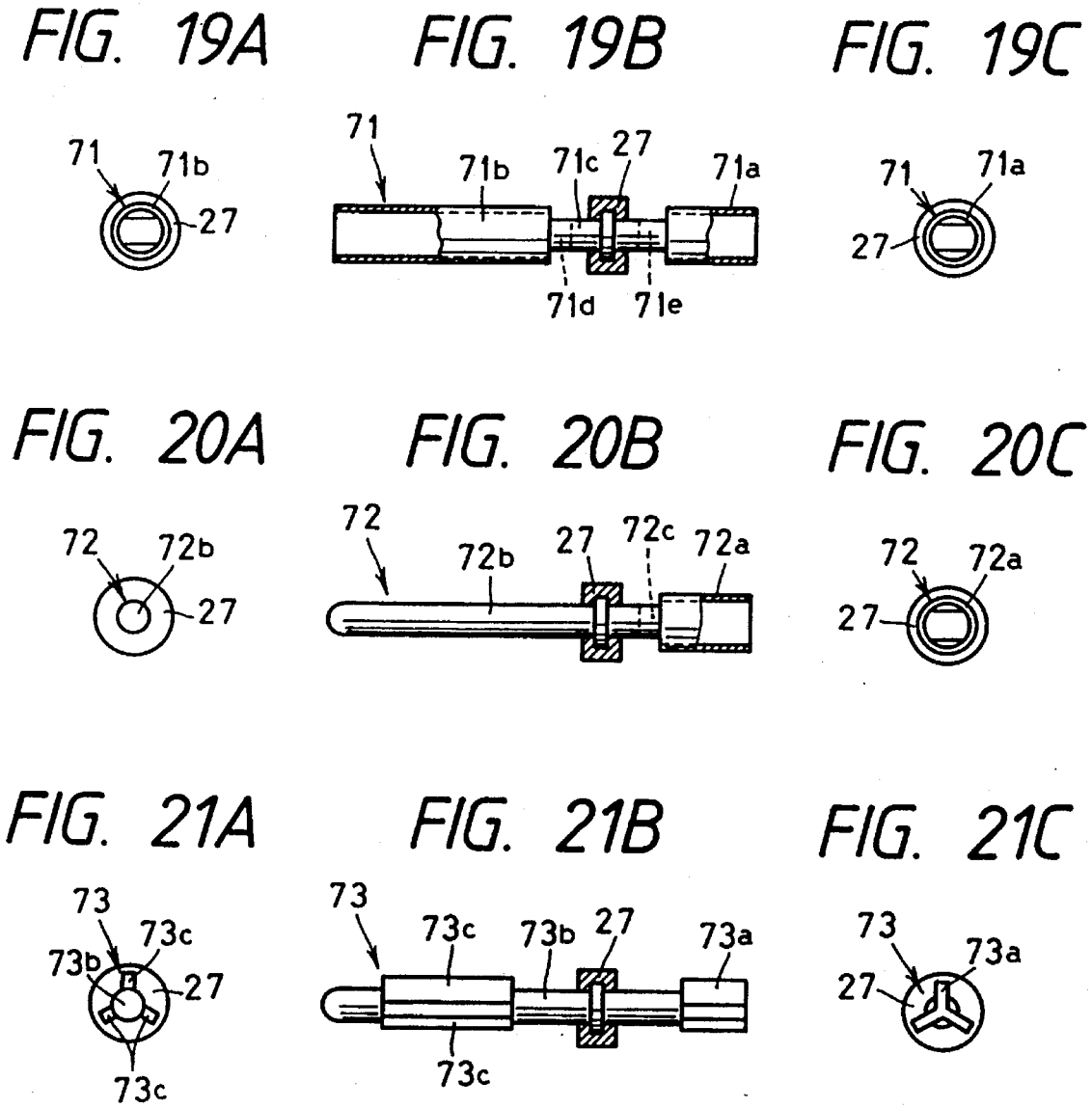
FIGS. 19A, 19B and 19C are front, side and rear views respectively showing one example of a rod constituting a gas passage controller used in the embodiment shown in FIGS. 1 and 2 or FIGS. 11 and 12.
FIGS. 20A, 20B and 20C are front, side and rear views respectively showing another example of a rod constituting a gas passage controller used in the embodiment shown in FIGS. 1 and 2 or FIGS. 11 and 12.
FIGS. 21A, 21B and 21C are front, side and rear views respectively showing a further example of a rod constituting a gas passage controller used in the embodiment shown in FIGS. 1 and 2 or FIGS. 11 and 12.

The rod 71 shown in,FIGS. 19A, 19B and 19C has a tubular rear portion 71*a*, a tubular body portion 71*b* and a connecting portion 71*c* provided between the tubular rear portion 71*a* and the tubular body portion 71*b*. The tubular rear portion 71*a* is put in the bullet supplying gas passage 22 and the tubular body portion 71*b* extends from the connecting portion 71*c* toward the bullet holding chamber 4*a*. The valve 27 is mounted on the connecting portion 71*c* which is provided therein with an opening 71*d* connected to the inside of the tubular rear portion 71*a* and an opening 71*e* connected to the inside of the tubular body portion 71*b*.

When the rod 71 is so positioned as to cause the valve 27 to make the bullet supplying gas passage 22 closed, the gas which is to be supplied to the bullet holding chamber 4*a* is introduced through the opening 71*d* into the tubular body portion 71*b*, and when the rod 71 is so positioned as to cause the valve 27 to make the bullet shooting gas passage 21 closed, the gas which is to be supplied to the pressure chamber portion is introduced through the opening 71*e* into the tubular rear portion 71*a*.

The rod 71 is considerably lightened because of the tubular rear portion 71*a* and the tubular body portion 71*b*. Further, since the tubular body portion 71*b* has an uniform inside diameter over all and therefore the pressure of the gas which is supplied through the tubular body portion 71*b* to act on the sham bullet BB held in the bullet holding chamber 4*a* is operative to prevent the sham bullet BB from spinning, the direction of the sham bullet BB shot from the barrel 2 is properly set without being undesirably varied.

The rod 72 shown in FIGS. 20A, 20B and 20C has a tubular rear portions 72*a* and a solid body portion 72*b* having a front end of semispherical shape. The tubular rear portion 72*a* is put in the bullet supplying gas passage 22 and the solid body portion 72*b* extends from the tubular rear portion 72*a* toward the bullet holding chamber 4*a*. The valve 27 is mounted on the solid body portion 72*b*. An opening 72*c* connected to the inside of the tubular rear portion 72*a* is formed between the tubular rear portion 72*a* and the valve 27.

When the rod 72 is so positioned as to cause the valve 27 to make the valve 27 to make the bullet supplying gas passage 22 closed, the gas which is to be supplied to the bullet holding chamber 4*a* is directly introduced into the bullet shooting gas passage 21, and when the rod 72 is so positioned as to cause the valve 27 to make the bullet shooting gas passage 21 closed, the gas which is to be supplied to the pressure chamber portion is introduced through the opening 72*c* into the tubular rear portion 72*a*.

The rod 72 is lightened because of the tubular rear portion 72*a*. Further, since the solid body portion 72*b* contributes to leave the bullet shooting gas passage 21 having a relatively large effective cross section therein, the pressure of the gas which is supplied through the bullet shooting gas passage 21 to act on the sham bullet BB held in the bullet holding chamber 4*a* is increased and therefore the speed of the sham bullet BB shot from the barrel 2 is effectively increased.

The rod 73 shown in FIGS. 21A, 21B and 21C has a rear portion 73*a* having a cross section of the trifurcate shape and a solid body portion 73*b* having three projections 73*c* projecting radially therefrom and a front end of semi-spherical shape. The rear portion 73*a* is put in the bullet supplying gas passage 22 and the solid body portion 73*b* extends from the rear portion 73*a* toward the bullet holding chamber 4*a*. The valve 27 is mounted on the solid body portion 73*b* between the rear portion 73*a* and the projections 73*c*.

When the rod 73 is employed, the gas passing through the bullet shooting gas passage 21 to the bullet holding chamber 4*a* is rectified by the projections 73*c* and therefore the pressure of the gas which act on the sham bullet BB held in the bullet holding chamber 4*a* is operative to prevent the sham bullet BB from spinning, so that the direction of the sham bullet BB shot from the barrel 2 is properly set without being undesirably varied.

Further, although the case 30 provided therein with the pressure accumulating chamber 33 in which the liquefied gas is contained is held in the grip 6 in each of the embodiments shown in FIGS. 1 and 2 and FIGS. 11 and 12, respectively, it is possible to use compressed air in place of the liquefied gas. It is also possible to modify the case 30 to be provided therein a pressure accumulating chamber coupled with a bomb in which a large quantity of liquefied gas or compressed air can be contained.

What is claimed is:

1. A model gun with automatic bullet supplying mechanism, which comprising:

a magazine for containing sham bullets provided in a grip, a pressure accumulating chamber provided in the grip for accumulating gas pressure, a bullet holding chamber provided at the back of a barrel to be close to one end of the magazine, a slider provided to be movable along the barrel, a pressure chamber with variable capacity provided in the slider to be positioned at the back of the barrel, a movable member provided between the bullet holding chamber and the pressure chamber, and a gas passage controller provided to be movable in the movable member for controlling each of a first gas passage extending from the pressure accumulating chamber through the movable member to the bullet holding chamber and a second gas passage extending from the pressure accumulating chamber through the movable member to the pressure chamber to be open and closed selectively, said gas passage controller being operative selectively to control the first gas passage to be open so that gas discharged from the pressure accumulating chamber is supplied through the first gas passage to the bullet holding chamber and to control the second gas passage to be open so that gas discharged from the pressure accumulating chamber is supplied through the second gas passage to the pressure chamber to cause each of the slider and the movable member to move back for making preparations for supplying the bullet holding chamber with the sham bullet from the end of the magazine.

2. A model gun with automatic bullet supplying mechanism according to claim 1, wherein said gas passage controller comprises a movable valve member for controlling each of the first and second gas passages to be open and closed selectively.

3. A model gun with automatic bullet supplying mechanism according to claim 1, wherein each of the first and second gas passages is divided into sections so that the gas in the pressure chamber is exhausted through the second gas passage divided into sections and thereby the movable member is moved back and the gas passage controller is operative to make preparations for supplying the bullet holding chamber with the sham bullet from the end of the magazine when the slider reaches to the rearmost position.

4. A model gun with automatic bullet supplying mechanism according to claim 1 further comprising a spring member provided in relation to the slider for charging elastic force when the slider moves back and causing the slider and the movable member accompanying with said slider to be moved forward with the elastic force after the preparations for supplying the bullet holding chamber with the sham bullet from the end of the magazine have been done, wherein said movable member moving forward is operative to carry the sham bullet from the end of the magazine to the bullet holding chamber.

* * * * *